US008801516B2

(12) United States Patent
Shigeta

(10) Patent No.: US 8,801,516 B2
(45) Date of Patent: Aug. 12, 2014

(54) CARD READING DEVICE AND CARD GAME FRAUD DETECTION DEVICE

(75) Inventor: Yasushi Shigeta, Kyoto (JP)

(73) Assignee: Angel Playing Cards Co., Ltd., Osaka (JP)

( * ) Notice: Subject to any disclaimer, the term of this patent is extended or adjusted under 35 U.S.C. 154(b) by 0 days.

(21) Appl. No.: 13/105,524

(22) Filed: May 11, 2011

(65) Prior Publication Data

US 2011/0210175 A1 Sep. 1, 2011

Related U.S. Application Data

(60) Continuation of application No. 11/929,749, filed on Oct. 30, 2007, now Pat. No. 7,967,672, which is a division of application No. 10/542,073, filed as application No. PCT/JP03/16879 on Dec. 26, 2003, now abandoned.

(51) Int. Cl.
*A63F 9/24* (2006.01)
*A63F 1/18* (2006.01)

(52) U.S. Cl.
CPC ..... *A63F 1/18* (2013.01); *A63F 2009/2419* (2013.01); *A63F 2250/58* (2013.01)
USPC ..... 463/13; 463/29; 235/468

(58) Field of Classification Search
USPC ..... 463/13, 29; 235/468, 492, 451
See application file for complete search history.

(56) References Cited

U.S. PATENT DOCUMENTS

| | | | | |
|---|---|---|---|---|
| 4,513,696 | A | | 4/1985 | Fujii et al. |
| 4,513,969 | A | | 4/1985 | Samsel, Jr. |
| 4,534,562 | A | | 8/1985 | Cuff et al. |
| 4,586,712 | A | | 5/1986 | Lorber et al. |
| 4,794,239 | A | | 12/1988 | Allais |
| 5,067,713 | A | | 11/1991 | Soules et al. |
| 5,166,502 | A | | 11/1992 | Rendleman et al. |
| 5,169,155 | A | * | 12/1992 | Soules et al. ..... 273/293 |
| 5,259,907 | A | | 11/1993 | Soules et al. |
| 5,331,141 | A | | 7/1994 | Kaneko |
| 5,374,061 | A | | 12/1994 | Albrecht |
| 5,669,816 | A | | 9/1997 | Garczynski et al. |
| 5,707,287 | A | | 1/1998 | McCrea, Jr. |
| 5,722,893 | A | | 3/1998 | Hill et al. |
| 5,779,546 | A | | 7/1998 | Meissner et al. |

(Continued)

FOREIGN PATENT DOCUMENTS

| | | | |
|---|---|---|---|
| JP | 565248 | U | 1/1981 |
| JP | 63311656 | A | 12/1988 |

(Continued)

OTHER PUBLICATIONS

Japanese Office Action issued Aug. 30, 2011 corresponding to Japanese Application No. 2007-235828.

(Continued)

*Primary Examiner* — Ahshik Kim
(74) *Attorney, Agent, or Firm* — Sheppard, Mullin, Richter & Hampton LLP

(57) ABSTRACT

A card used in a card game includes a code including at least two sets of code elements printed in UV-luminous ink on a surface of the card, the sets of code elements provided on one side of the surface of the card along a reading direction of a code reader.

15 Claims, 17 Drawing Sheets

(56) References Cited

U.S. PATENT DOCUMENTS

| | | | | |
|---|---|---|---|---|
| 5,814,804 | A | 9/1998 | Kostizak | |
| 5,911,626 | A | 6/1999 | McCrea, Jr. | |
| 5,941,769 | A | 8/1999 | Order | |
| 6,039,650 | A | 3/2000 | Hill | |
| 6,042,150 | A | 3/2000 | Daley | |
| 6,066,857 | A | 5/2000 | Fantone et al. | |
| 6,093,103 | A | 7/2000 | McCrea, Jr. | |
| 6,098,892 | A | 8/2000 | Peoples, Jr. | |
| 6,126,166 | A | 10/2000 | Lorson et al. | |
| 6,217,447 | B1 | 4/2001 | Lofink et al. | |
| 6,270,406 | B1 | 8/2001 | Sultan | |
| 6,460,848 | B1 | 10/2002 | Soltys et al. | |
| 6,527,191 | B1 | 3/2003 | Jannersten | |
| 6,582,301 | B2 | 6/2003 | Hill | |
| 6,588,751 | B1 | 7/2003 | Grauzer et al. | |
| 6,629,894 | B1 | 10/2003 | Purton | |
| 6,638,161 | B2 | 10/2003 | Soltys et al. | |
| 7,029,009 | B2 | 4/2006 | Grauzer et al. | |
| 7,093,130 | B1 | 8/2006 | Kobayashi et al. | |
| 7,172,507 | B2 | 2/2007 | Fujimoto et al. | |
| 7,222,852 | B2 | 5/2007 | Soltys et al. | |
| 2002/0068635 | A1 | 6/2002 | Hill | |
| 2002/0155869 | A1 | 10/2002 | Soltys et al. | |
| 2002/0163125 | A1 | 11/2002 | Grauzer et al. | |
| 2002/0165029 | A1 | 11/2002 | Soltys et al. | |
| 2003/0171142 | A1 | 9/2003 | Kaji et al. | |
| 2003/0176209 | A1 | 9/2003 | Soltys et al. | |
| 2003/0195025 | A1 | 10/2003 | Hill | |
| 2004/0026636 | A1 | 2/2004 | Shigeta | |
| 2004/0100026 | A1 | 5/2004 | Haggard | |
| 2005/0121852 | A1 | 6/2005 | Soltys et al. | |
| 2005/0137005 | A1 | 6/2005 | Soltys et al. | |
| 2007/0225055 | A1* | 9/2007 | Weisman | 463/11 |

FOREIGN PATENT DOCUMENTS

| | | | |
|---|---|---|---|
| JP | 0371450 | U | 7/1991 |
| JP | 05-020512 | | 1/1993 |
| JP | H5-398 | | 1/1993 |
| JP | 0612539 | A | 1/1994 |
| JP | 06266881 | A | 9/1994 |
| JP | 08199101 | A | 8/1996 |
| JP | 9-215812 | | 8/1997 |
| JP | 11267264 | A | 10/1999 |
| JP | 11301121 | A | 11/1999 |
| JP | 2001222687 | | 8/2001 |
| JP | 2001276297 | A | 10/2001 |
| JP | 200249888 | A | 2/2002 |
| JP | 2002165916 | | 6/2002 |
| JP | 2002165916 | A | 6/2002 |
| JP | 2002224443 | | 8/2002 |
| JP | 2003052902 | | 2/2003 |
| JP | 2003070956 | | 3/2003 |
| JP | 2003144742 | | 5/2003 |
| JP | 2003250950 | | 9/2003 |
| JP | 2004215806 | A | 8/2004 |
| JP | 2005198668 | | 7/2005 |
| JP | 2005267625 | | 9/2005 |
| JP | 2005296634 | | 10/2005 |
| JP | 2007236995 | | 9/2007 |
| JP | 2008188471 | | 8/2008 |
| WO | 96/14115 | | 5/1996 |
| WO | 01/56670 | A1 | 8/2001 |
| WO | 02/064225 | A1 | 8/2002 |
| WO | 0264225 | A1 | 8/2002 |
| WO | 03026763 | | 4/2003 |

OTHER PUBLICATIONS

Japanese Office Action issued Aug. 23, 2011 corresponding to Japanese Application No. 2007-211666.

Non-Final Office Action dated Mar. 19, 2010 issued to U.S. Appl. No. 12/231,657.

Final Office Action dated Apr. 14, 2010 issued to U.S. Appl. No. 10/542,073.

Non-Final Office Action dated Oct. 1, 2010 issued to U.S. Appl. No. 11/929,727.

Non-Final Office Action dated Nov. 23, 2010 issued to U.S. Appl. No. 12/825,261.

Final Office Action dated Dec. 8, 2010 issued to U.S. Appl. No. 12/231,657.

Non-Final Office Action dated Dec. 8, 2010 issued to U.S. Appl. No. 11/884,021.

Non-Final Office Action dated Jan. 20, 2011 issued to U.S. Appl. No. 10/542,073.

Non-Final Office Action dated Mar. 7, 2011 issued to U.S. Appl. No. 11/929,727.

* cited by examiner

CARD READING DEVICE AND CARD GAME FRAUD DETECTION DEVICE

RELATED APPLICATIONS

This application is a continuation of application Ser. No. 11/929,749, filed Oct. 30, 2007, which is a divisional of application Ser. No. 10/542,073, filed Mar. 13, 2006, which is a U.S. national phase application based on International Patent Application No. PCT/JP2003/016879, filed Dec. 26, 2003, and claims the priority of Japanese Patent Application No. 2003-5319, filed Jan. 14, 2003, the contents all of which are incorporated herein by reference in their entirety.

TECHNICAL FIELD

The present invention relates to a card reading device and a card game fraud detection device, and specifically relates to a device for detecting a fraud in a card game that is continuously played on a table.

BACKGROUND

One of devices of this kind is disclosed in International Publication WO 02/064225 A1. In the document, a code representing a group (or set) to which a card belongs is provided on the card by printing or the like. An inspection device in FIGS. 6 and 8 in the document reads a code from each card of a used group (see pages 15 to 17). Based on a code read from a card, the inspection device then judges whether an abnormal card is mixed in the group or not.

The above-mentioned conventional device is conducive to preventing fraud by inspecting whether a card belongs to a predetermined group or not. However, it may be difficult for such a device to detect a fraud on the spot when a fraud is committed.

In Baccarat, for example, cards are dealt to two players (Baccarat is played by a player and a banker as is commonly known, but a banker is called a player in the present application). In a game of Baccarat, a player turns over a card in a manner called "squeeze." The right of "squeeze" is given generally to a player who made the highest bet. At the time of this "squeeze," a fraud player substitutes a card by a magician-like technique. It is desirable to be able to detect such a fraud on the spot.

Players could be forbidden to turn over a card in order to prevent a fraud. However, turning over a card by a player is an important factor in the fun of a game of Baccarat. Particularly, having the right of "squeeze" is high status in Baccarat, so "squeeze" is important for the fun of the game.

Though the above example referred to Baccarat, it is also desired to detect a fraud on the spot in Poker or other games as well.

In addition, various inspection devices have been proposed besides the above-mentioned conventional device, but many conventionally proposed devices comprise a mechanism to successively transfer a lot of cards in order to inspect the whole group at a time, and they are relatively large. Under these circumstances, it is required to enable reliable detection of frauds with a simple and inexpensive configuration.

SUMMARY OF THE INVENTION

A purpose of the invention made in the above-mentioned background is to provide a device that can detect a fraud in a card game on the spot.

Another purpose of the invention is to provide a device that can detect a fraud with a relatively simple and inexpensive configuration.

To achieve the above purposes, card reading device for reading information on a card which is used in a card game on a table, which comprises a rail for guiding a card, at least two card sensors, for detecting a passing card which is slid by hand and guided by the rail, which are placed in a card sliding direction with a certain gap, at least two reading sensors for reading code attached to the card, which are placed between the two card sensors in the card sliding direction, wherein the card have the cord which is printed in UV-luminous ink on the card, the code comprises at least two code rows which are placed across the card sliding direction with a certain gap, the two reading sensors are placed in positions which correspond to the gap of the two code rows, and the card sensors output signal for detecting a position of the passing card.

In the present invention, a card reading device further comprises a reading instruction section which controls a function of the reading sensor by means of signal from the card sensor.

In the present invention, a group code is attached to the card, a group being one deck or a plurality of decks, and the reading sensor have a function for reading the group code.

Another aspect of the invention is a card game fraud detection device comprises a card reading device as described above and a shooter from which a dealer takes out the card, wherein the shooter is provided with the card reading device.

A card game fraud detection device detects a fraud in a card game that is continuously played. The device comprises: an entering card information obtaining means for obtaining entering card information to identify an entering card that is a card entering each game; an entering card information storage means for storing the entering card information while a game is being played; a leaving card information obtaining means for obtaining leaving card information to identify a leaving card that is a card leaving a game; a judgment means for judging whether the entering card and the leaving card are identical or not based on the entering card information and the leaving card information; and an output means for outputting a judgment result.

The above device judges whether an entering card and a leaving card are identical or not, and outputs the judgment result. Therefore, when a card is fraudulently substituted in a game, this act of substitution can be detected.

The device has only to obtain information on entering cards and leaving cards. In a game of Baccarat, for example, the numbers of entering cards and leaving cards are at most six. For this reason, a means to transfer a group of cards need not be provided, so that the device can be composed simply and inexpensively.

By the way, entering card information and leaving card information may be minimum information required according to a rule of a card game to which the device is applied. Card marks are represented by suits (spades, hearts, diamonds, and clubs) and ranks (numerals 1 to 10, J, Q, and K). In Baccarat, suits do not affect a game, and J, Q, and K are treated as 10 (or zero). Therefore, entering card information and leaving card information may only be 1 to 10 (J, Q, and K are included in 10). Much more information may of course be obtained.

Moreover, within the scope of the invention, the device may use as entering card information and leaving card information a code representing a group (or set). A group is one deck for example, or a plurality of decks for example. A group code attached to an entering card is compared with a group code attached to a leaving card. Conformity between an entering card and a leaving card can also be judged in this case. Information other than a group code, which brings the same result, may of course be used.

The card game fraud detection device typically has a reading means for reading information from a card, wherein the entering card information obtaining means and the leaving card information obtaining means obtain information that is read by the reading means.

The reading means may read a code that can identify each card, the code being given to each card. The reading means preferably reads from a card a code that is invisible to a naked human eye under normal use conditions and that visible under certain conditions. The reading means reads a code that becomes visible, for example, when irradiated by prescribed light. This allows detection of fraud without bringing discomfort to players or the like.

The reading means may read a code that is set up so as not to correspond to a mark on a card. A code may not correspond to a mark on a card. The device need not recognize a mark on a card. Since the device is only required to judge conformity between an entering card and a leaving card, fraud can be detected without identifying a mark on a card. As the device does not recognize a mark on a card, a player's feeling that a game is played fairly can be further increased.

The reading means may read a mark on each card. When the following configuration is adopted, the device can be further simplified.

The reading means preferably detects a mark in at least two mark rows of three longitudinal mark rows of a card. The at least two mark rows are a central mark row and one of mark rows on both sides. Since arrangements of marks on cards are fixed, marks on cards can be identified by the above simple configuration.

As previously described, it is enough to obtain minimum information required according to a rule of a game. In Baccarat, for example, suits of marks need not be detected. Preferably, when no mark can be identified in mark rows, the card is judged a face card (J, Q, or K). A face card may be treated as 10 (or zero) in Baccarat.

The reading means may detect a mark in at least five mark rows of nine transverse mark rows of a card. The at least five mark rows are a central mark row, one of mark rows on both edges, two mark rows on both sides of a center of an Eight card, and one of two mark rows on both sides of a center of a Ten card. A mark can also be identified.

Preferably, the reading means is embedded in a table and includes a sensor for reading information from a card that slides on the table. This allows information to be obtained from a card on a table, so that a player's feeling that a game is played fairly can be further increased.

Information is preferably read from the entering card and the leaving card by a common sensor. For example, a sensor is provided at the center of a table or at other appropriate places, and entering cards and leaving cards are slid on the sensor. Since the number of sensors can be small, the configuration becomes simple.

Preferably, the device comprises a rail for guiding a card when the card slides, the rail being provided to protrude from the table, wherein a positional relationship between the sensor and the rail is set up in such a way that information on a card passes through the sensor when the card slides with a side of the card being in contact with the rail. This allows information on a card to be read reliably.

The reading device may comprise an entering reading means and a leaving reading means as follows: an entering reading means reads information from an entering card, the entering reading means being provided at a shooter or at a path through which a card enters from a shooter; and a leaving reading means reads information from a leaving card, the leaving reading means being provided at a card recovery (or leaving) opening or at a path through which a card leaves through a card recovery opening. As above, separate sensors may be provided for an entering card and a leaving card.

In addition, the device may comprise a reading means provided at a path through which a card is guided in association with a shooter and recovery opening. This allows information to be read reliably from a card even if the above-described rail is not especially provided.

The device may comprise: an information attachment means for attaching a code to a card when the card enters; and a reading means for reading a code when a card leaves, the code being attached by the information attachment means. The entering card information obtaining means obtains as the entering card information information that is attached by the information attachment means, and the leaving card information obtaining means obtains as the leaving card information information that is read by the reading means. The information attachment means may print a code on a card.

In the invention, a code is attached when a card enters. Above-mentioned advantages can be successfully obtained also with such a configuration. In this configuration, a code need not correspond to a mark. A code may represent, for example, a random number without regard to a mark. In this case, a mark on a card need not be recognized by the detection device. Even if a mark is not recognized, a comparison between an entering card and a leaving card can be made, so that a fraud is detected. As the device does not recognize a mark on a card, a player's feeling that a game is played fairly can be further increased.

The output means preferably outputs a judgment result in such a way that whether entering card information and leaving card information of each of a plurality of players are identical or not can be distinguished. The device can identify a player who committed a fraud.

Another aspect of the device is a card game fraud detection device, which comprises: a reader for reading information on a card, the reader being provided at or near a table; and a judgment means for judging whether an entering card that is a card entering a game and a leaving card that is a card leaving a game are identical or not based on information that is read by the reader.

This allows detection of fraud in a card game, with a simple configuration comprising a reader provided at or near a table. Any conventional and common device for continuously transferring a card need not be provided. A fraud can be detected on the spot by judging whether an entering card and a leaving card are identical or not.

By the way, information on a card is, for example, the above code and mark.

Additionally, the reader typically reads, but not limited to, information from both of an entering card and a leaving card. For example, when a card enters from a shooter, a code is printed on the card and the printed code is stored. A code is then read from a leaving card by the reader. The read code is compared with the stored code. In this case, the reader reads information only from a leaving card.

In another example, the reader reads from a leaving card a code representing a group. The read code is then compared with a group reserved in a card-providing source (shooter etc.). Preferably, a group of new cards or a group of previously inspected cards is placed in the card-providing source. Conformity between an entering card and a leaving card can also be judged in this configuration, provided that cards of the same group are placed in the card-providing source. Information other than a group code, which brings the same result, may of course be used.

"At or near a table" means a part of a path through which a card passes in a game. For example, in a case where the table comprises a shooter, i.e. a card-providing source, and a storage section for used cards, "at or near a table" is a part somewhere in a path that passes though the table from the card-providing source to the storage section. The reader is therefore typically provided at, but not limited to, a part on a table. For example, the reader may be provided at a recovery opening for the purpose of the above configuration for reading information only from a leaving card.

The reader is preferably provided at a base section which forms a part of a table and through which a card sliding on the table passes. This allows detection of fraud in a card game, with a simple configuration provided at a part of a table.

By the way, the base section may be a member different from the table and may be mounted at an opening provided at the table. Alternately, the base section need not be a member different from the table. In this case, the reader may be installed in an area of a member that forms the table.

The device preferably comprises a guide means for guiding a card so as to make the card pass through a path where the reader can read information. Preferably, the guide means comprises a rail for guiding a card when the card slides, the rail being provided to protrude from the table, and the rail is provided in such a way that information on a card passes through the reader when the card slides with a side of the card being in contact with the rail. This allows information on a card to be read reliably.

The device preferably has a plurality of sensors for detecting the existence of a card, the sensors being provided along the rail. Then, whether a card is sliding with a side of the card being in contact with the rail or not is detected based on whether the plurality of sensors detect a card or not. This allows information on a card to be read more reliably. Erroneous judgments caused by a card being slid at an inappropriate angle can be prevented.

Another aspect of the device is a mark reading device for reading a mark from a card. This device comprises: a detection means for detecting a mark in at least two mark rows of three longitudinal mark rows of a card, the at least two mark rows being a central mark row and one of mark rows on both sides; and a mark number determination means for determining the number of marks on a card based on a detection result of the detection means. This device determines the number of marks on a card, focusing on the fact that arrangements of marks on cards are fixed. This device is preferably applied to the above-described fraud detection device, but may also be applied to other devices that process cards.

Another aspect of the device is a card mark reading device for reading a mark from a card, and this device comprises: a detection means for detecting a mark in at least five mark rows of nine transverse mark rows of a card, the at least five mark rows being a central mark row, one of mark rows on both edges, two mark rows on both sides of a center of an Eight card, and one of two mark rows on both sides of a center of a Ten card; and a mark number determination means for determining the number of marks on a card based on a detection result of the detection means. This device, too, determines the number of marks on a card, focusing on the fact that arrangements of marks on cards are fixed. This device, too, is preferably applied to the above-described fraud detection device, but may also be applied to other devices that process cards.

The detection means can detect a difference in color between a mark and a part where there is no mark on a card. Typically, red and black are distinguished from white. Since it is enough to be able to detect a difference in color, a simple sensor can be applied, so that costs can be reduced. For example, under the rules of Baccarat, suits of cards do not affect a game. The device is preferably used for such a case.

Preferably, when no mark can be identified in mark rows, the card is judged a face card (J, Q, or K). A face card may be treated as 10 (or zero) in a game of Baccarat or the like.

The card mark reading device preferably comprises a guide means for guiding a card so as to make a mark row of the card pass through the detection means. The guide means may comprise a rail for guiding a card when the card slides, the rail being provided to protrude from a table on which a card game is played. In this case, a positional relationship between the detection means and the rail is set up in such a way that a mark row passes through the detection means when the card slides with a side of the card being in contact with the rail. This allows the number of marks on a card to be determined reliably.

The device is not limited to the above-described aspects, i.e. the card game fraud detection device and the card mark reading device. Another aspect of the idea of the device is, for example, a method performed by the above devices, a program making a computer perform such a method, or a storage medium storing such a program.

The present invention allows detection of fraud in the card game on the spot.

DETAILED DESCRIPTION OF THE PREFERRED EMBODIMENTS

Now, a preferred embodiment of the invention will be described with reference to the drawings.

Figure 1:
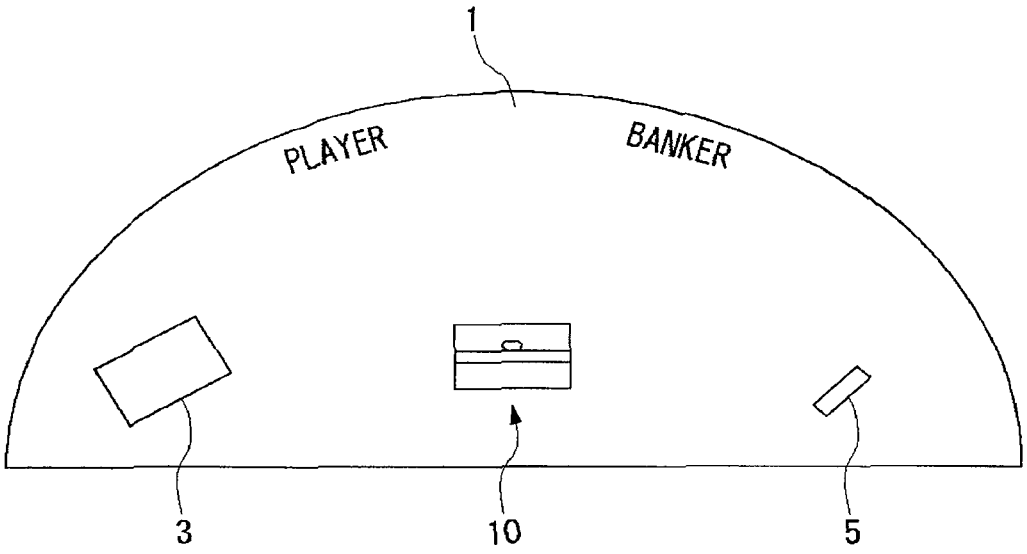
FIG. 1 shows a table on which a card game fraud detection device of an embodiment of the invention is provided.

FIG. 1 shows a table on which a card game fraud detection device of the embodiment is provided. This table 1 is used in Baccarat. However, the invention can of course also be applied to a game other than Baccarat.

Though the table 1 is shown in a simplified schematic in FIG. 1, a common Baccarat table may be applied when the invention is practiced. As is commonly known, Baccarat is played by a player and a banker. However, both of a player and a banker are called a player in the present application.

As shown in FIG. 1, a shooter 3 and a recovery opening 5 are provided on both sides of the table 1, respectively. The shooter 3 is a providing source of cards, and cards released from the shooter 3 are dealt to players. After an end of a game, cards are discharged through the recovery opening 5 to be stored in a storage section for used cards (not shown).

Here in the embodiment, a card that enters each game is called an entering card, and a card that leaves each game is called a leaving card. An entering card enters a game through the shooter 3 to the table, and a leaving card leaves from the table through the recovery opening 5.

As shown in FIG. 1, the card game fraud detection device of the embodiment (hereinafter called the fraud detection device) 10 is placed approximately in the center of the table 1. This position is set up in such a way that a dealer easily passes a card through the fraud detection device 10.

Figure 2:
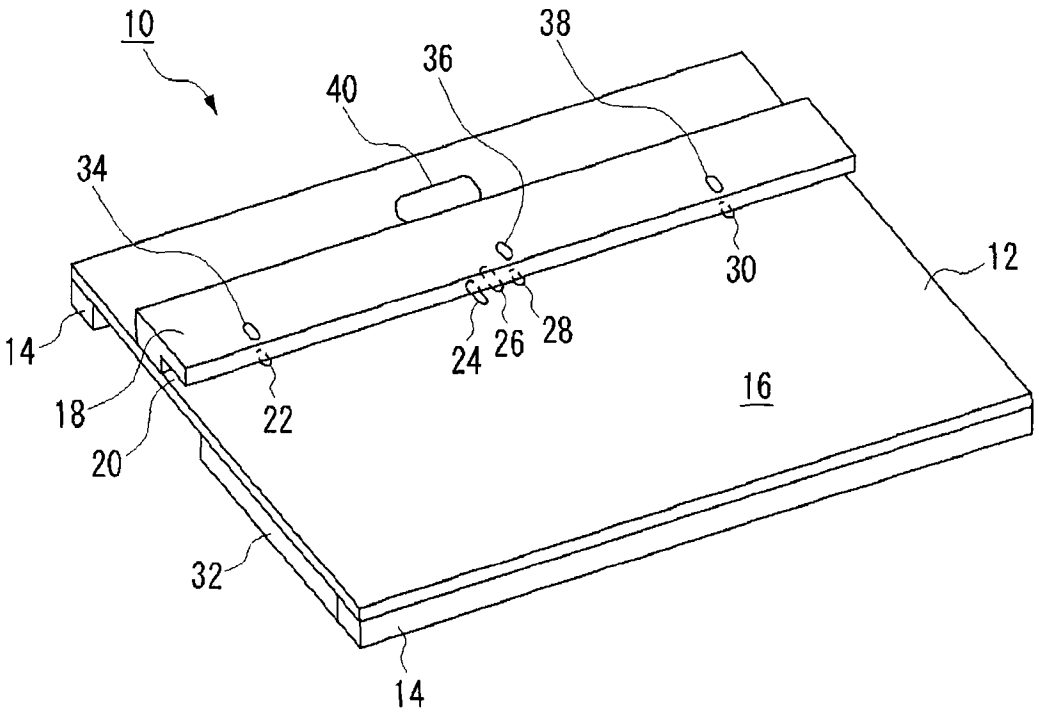
FIG. 2 is a perspective view of the fraud detection device.

FIG. 2 is a perspective view of the fraud detection device 10. A base plate 12 comprising a flat plate is attached to an opening of the table 1. Two rod-shaped mounting members 14 are attached to the base plate 12 along both edges of it, and these mounting members 14 are put on steps provided at the opening of the table 1. The base plate 12 has, for example, a rectangular shape of 210 mm×130 mm.

In a state that the base plate 12 is mounted on the table 1, the height of a slide surface 16, i.e. the top surface of the base plate 12, is almost the same as that of the top surface of the table 1, and therefore the slide surface 16 is in the same plane as the table 1. A card is slid on the table 1 so as to pass through the slide surface 16.

On the base plate 12, a rail 18 for guiding a card is provided. The rail 18 has an L shape. As shown in the figure, the rail 18 forms a gap (groove) 20 between itself and the table 1. A card is inserted into the gap 20. The card is then slid with a side of the card being in contact with the rail 18 at the bottom of the gap 20. This allows the card to be guided along the rail 18.

In addition, a plurality of windows 22 to 30 are provided in the base plate 12 along the rail 18. These windows 22 to 30 are partially or completely hidden under the rail 18 when the base plate 12 is seen from above.

The windows 22 to 30 are provided at positions corresponding to a plurality of sensors provided under the base plate 12. These plurality of sensors are mounted on a sensor mounting plate 32, which is attached to the underside of the guide plate 12. Also in the rail 18, three windows 34, 36, and 38 are provided at positions corresponding to the windows 22, 28, and 30.

Moreover, another window 40 is provided on the base plate 12. The window 40 is provided on the opposite side of the windows 22 to 30 with respect to the rail 18. The window 40 is used for showing a judgment result. Though not shown, an LED device is mounted on the base plate 12. The window 40 is provided at a position corresponding to a lamp of the LED device.

Figure 3:
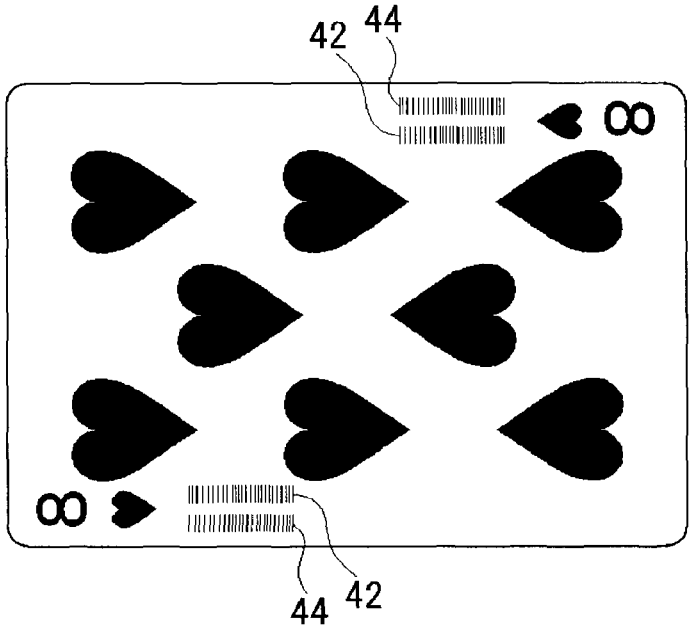
FIG. 3 shows a card to be inspected.

FIG. 3 shows a card to be inspected. As shown in the figure, codes 42 and 44 are attached along long sides of a card. The codes 42 and 44 are placed on all cards including face cards (J, Q, and K) at positions where no mark is printed.

The codes 42 and 44 are barcodes corresponding to marks on a card. One of the codes 42 and 44 represents a suit (spade, heart, diamond, or club), and the other represents a rank (value, 1, 2 . . . 10, J, Q, or K). For example, the code 42 represents a suit, and the code 44 represents a rank.

The codes 42 and 44 are printed in UV-luminous ink. UV-luminous ink cannot be read by human eyes under normal use conditions. However, UV-luminous ink emits colored light when exposed to ultraviolet rays. Ultraviolet rays used for seeing UV-luminous ink is called black light.

Figure 4:
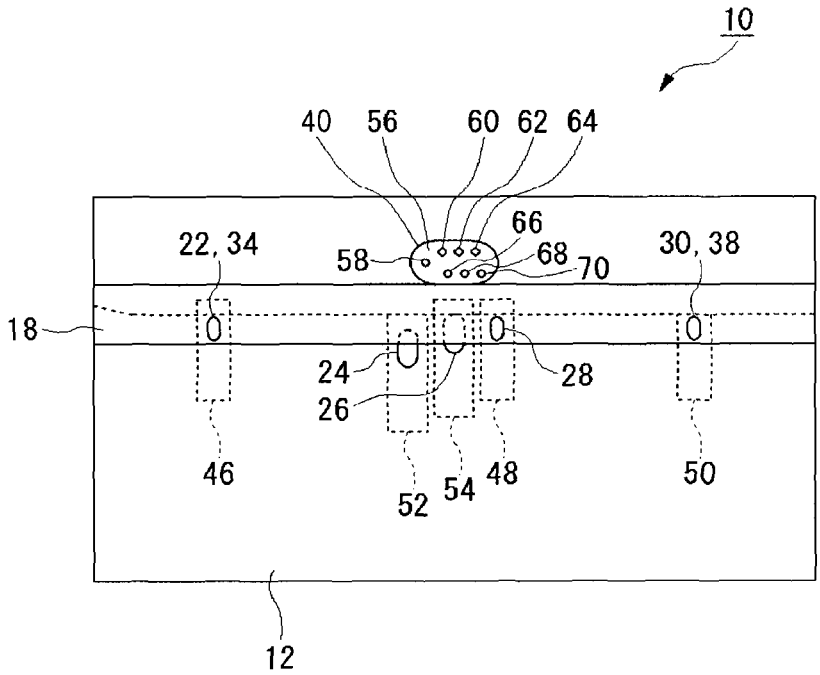
FIG. 4 is a top view of the fraud detection device.

FIG. 4 is a top view of the fraud detection device 10. An entrance part of the gap of the rail 18 is cut obliquely. This allows a dealer to insert a card smoothly into the gap of the rail 18.

As shown by dotted lines, five sensors are provided under the base plate 12. A first card sensor 46, a second card sensor 48, and a third card sensor 50 are photoelectric sensors, and they detect the presence or absence of a card. The sensors 46, 48, and 50 are placed in the gap 20 between the rail 18 and the base plate 12, so that the sensors 46, 48, and 50 are positioned near a guide surface of the rail 18.

When a card is guided by the rail 18 to slide, a first reading sensor 52 and a second reading sensor 54 read the codes 42 and 44 attached to the card. The sensors 52 and 54 are placed in such a way that the first reading sensor 52 reads the code 42 and the second reading sensor reads the code 44. Light sources for visualizing the codes 42 and 44 are provided in the sensors 52 and 54. In the embodiment, the light sources are LEDs that emit ultraviolet rays (UV LEDs). Applying sensors equipped with such LEDs allows the device to be smaller.

Figure 5:
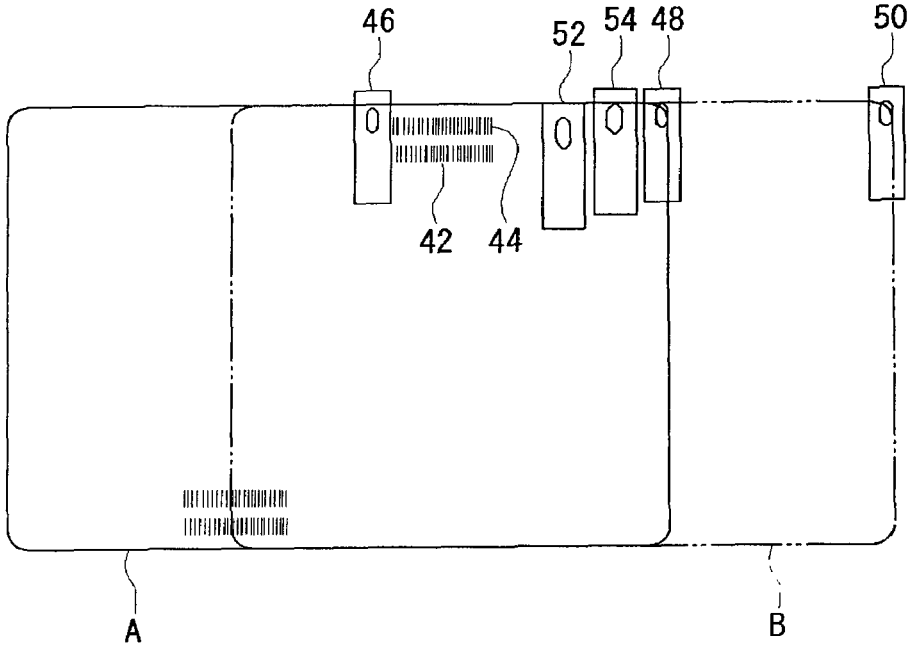
FIG. 5 shows a positional relationship between a card and sensors.

FIG. 5 shows a positional relationship between a card and the sensors. Suppose the card is slid and reaches a position A. When the card is at the position A, the first card sensor 46 and the second card sensor 48 detect the card at the same time. The first reading sensor 52 and the second reading sensor 54 are approaching the codes 42 and 44. At this position, the first reading sensor 52 and the second reading sensor 54 are controlled to start reading, and the codes are detected. When the card slides and reaches a position B, the card is detected by the second card sensor 48 and the third card sensor 50 at the same time.

In the above description, the detection of the card by the second card sensor 48 is a trigger to start reading.

Additionally, an attitude of the card is judged based on a detection result of the first card sensor 46, the second card sensor 48, and the third card sensor 50. This judgment is made in order to judge whether the card is sliding with a side of the card being in contact with the rail or not. It is judged that the card passed through in an appropriate attitude when: (1) the first card sensor 46, the second card sensor 48, and the third card sensor 50 detect the card in order; (2) these sensors detect that the card passed through (the card became nonexistent) in order; (3) the first card sensor 46 and the second card sensor 48 detect the card at the same time; and (4) the second card sensor 48 and the third card sensor 50 detect the card at the same time. In other cases, it is judged that the card did not pass through in an appropriate attitude. This judgment process is performed by a judgment computer device described later.

Returning to FIG. 4, an LED device 56 mounted on the underside of the base plate 12 is seen through a window 40 near the center part of the rail 18. The LED device 56 has seven LED elements.

An LED element 58 indicates a result of the above-described judgment of a card attitude. For example, the LED element 58 lights up to indicate that the attitude was appropriate.

LED elements 60 to 70 indicate a result of detecting the presence or absence of a fraud. More specifically, the LED elements 60 to 70 indicate a result of judging whether an entering card and a leaving card are identical or not. When one entering card is dealt, a code is read from the entering card and one LED element lights up. Then, if a leaving card and an entering card are identical when a code is read from a leaving card, a corresponding LED element goes off. The judgment process will be described further specifically later.

Figure 6:
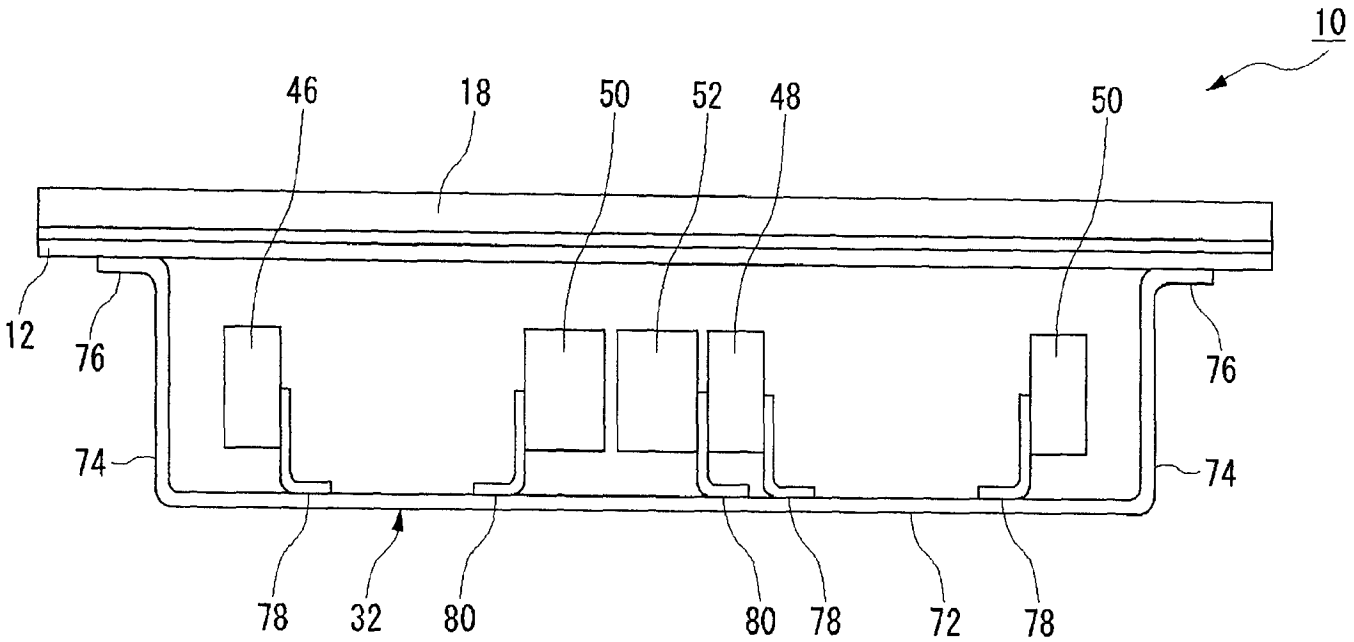
FIG. 6 is a front view of the fraud detection device.

FIG. 6 shows a front view of the fraud detection device 10. The sensor mounting plate 32 is formed by bending a sheet of plate member. The sensor mounting plate 32 has a flat section 72, wall sections 74 extending upward from both edges of the flat section 72, and flange sections 76 provided at upper edges of the wall sections 74. The flange sections 76 are attached to the underside of the base plate 12 with not shown bolts.

In the attached state, a space of appropriate size is formed between the flat section 72 and the base plate 12. The sensors 46 to 54 are provided in this space. As shown in the figure, the sensors 46 to 54 are mounted on the flat section 72 using L-shaped brackets 78 and 80. The height of each sensor is set depending on the detection distance of the sensor.

Figure 7:
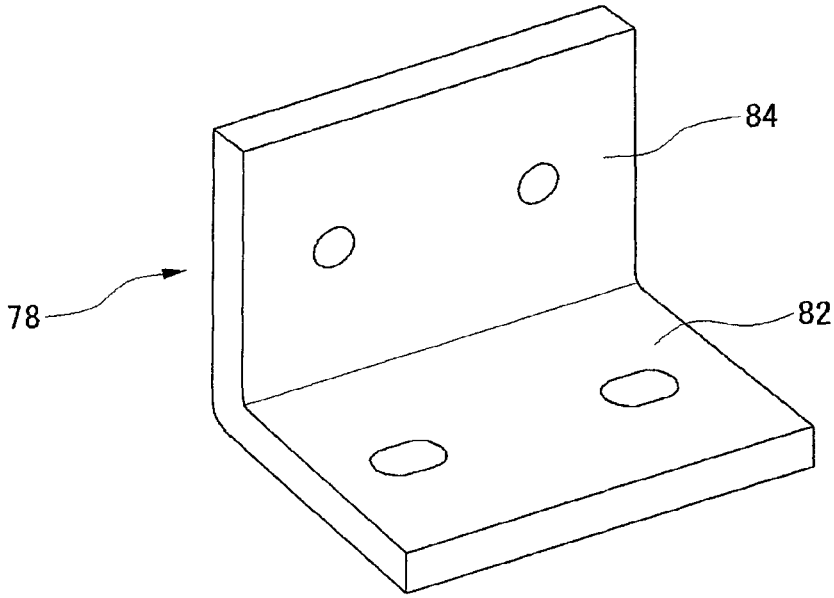
FIG. 7 shows a bracket for mounting a sensor.

FIG. 7 shows the bracket 78 for mounting the sensors 46 to 50. The bracket 78 is attached to the sensor mounting plate 32 with bolts (not shown) through holes 82, and is attached to the sensors 46 to 50 with bolts (not shown) through holes 84. Though not shown, brackets for the sensors 52 and 54 has the same configuration. However, the sizes of the brackets are of course different depending on the sizes and detection distances of the sensors.

Figure 8:
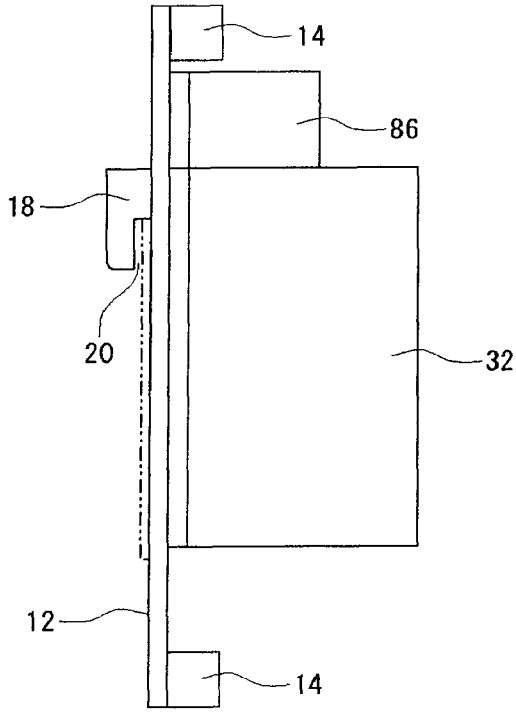
FIG. 8 is a side view of the fraud detection device.

FIG. 8 is a side view of the fraud detection device 10. The mounting members 14 are attached to both edges of the base plate 12 using bolts (not shown). As previously described, the mounting members 14 are used for mounting the present device on the table 1. For example, the mounting members 14 are stuck to the opening of the table 1. The mounting members 14 may be secured with screws or the like.

Also as previously described, a card (phantom line) is inserted into the gap 20 between the rail 18 and the base plate 12, and then the card is guided by the bottom surface of the gap 20. The rail 18 is attached to the base plate 12 with bolts (not shown), too.

In the embodiment, the rail 18 is secured to the base plate 12 at three places, i.e. the center and both edges. At both edges, the rail 18 and the sensor mounting plate 32 are secured to the base plate 12 with one bolt. A tapped hole is provided on the rail 18, and a bolt is tightened into this tapped hole from the underside of the sensor mounting plate 32.

Figure 9:
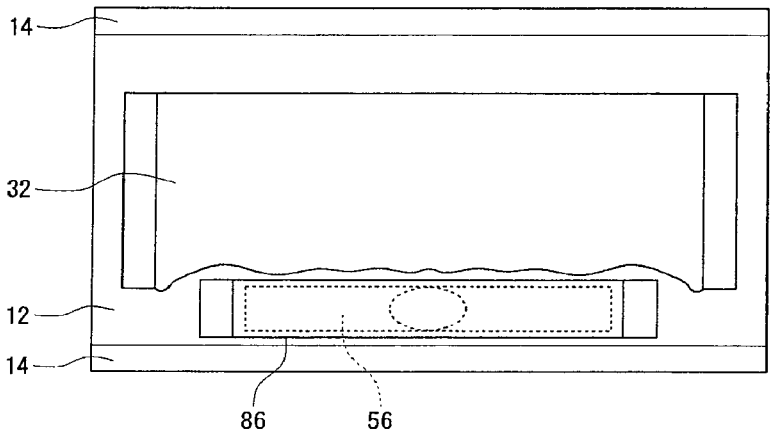
FIG. 9 is a bottom view of the fraud detection device.

FIG. 9 is a bottom view of the fraud detection device 10. FIG. 9 shows an LED box 86 for mounting the LED device 56. The LED device 56 is contained in the LED box 86, which is attached to the undersurface of the base plate 12. The attachment position is set in such a way that the position of the LED elements of the LED device 56 corresponds to the window 40 of the base plate 12.

Figure 10:
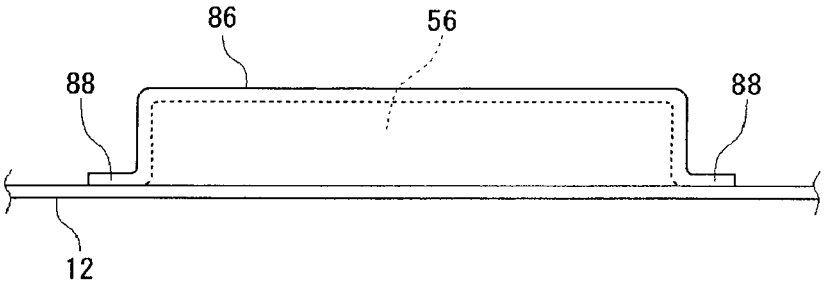
FIG. 10 is a view seen from an arrow X in FIG. 9.

FIG. 10 is a view seen from an arrow X in FIG. 9. The LED box 86 has flange sections 88 at its top edges. The flange sections 88 are attached to the base plate 12 using bolts (not shown).

Figure 11:
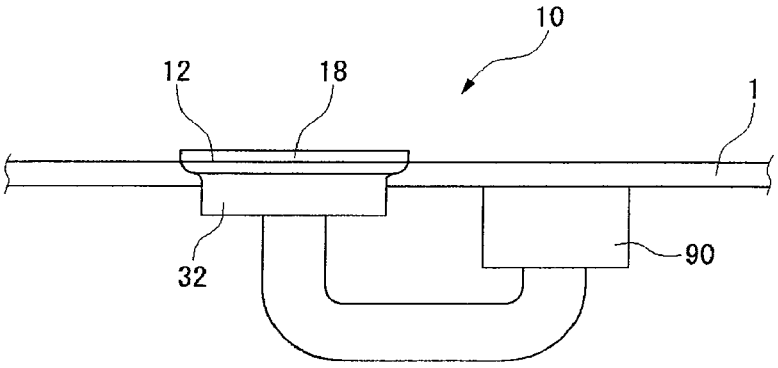
FIG. 11 shows the fraud detection device with the table.

FIG. 11 shows the fraud detection device 10 with the table 1. As shown in the figure, the fraud detection device 10 has a judgment computer device 90 along with the above-described configuration provided on the base plate 12. The judgment computer device 90 is mounted on the undersurface of the base plate 12 with a not shown bracket.

The judgment computer device 90 is connected with the sensors 46 to 54 mounted on the base plate 12 and with the LED device 56.

The judgment computer device 90 is composed of a microcomputer, and it has a common computer configuration including a CPU, a ROM, a RAM, and the like. By executing a program stored in the ROM, the judgment computer device 90 controls the sensors and LEDs of the base plate 12, and performs a process related to fraud detection.

Figure 12:
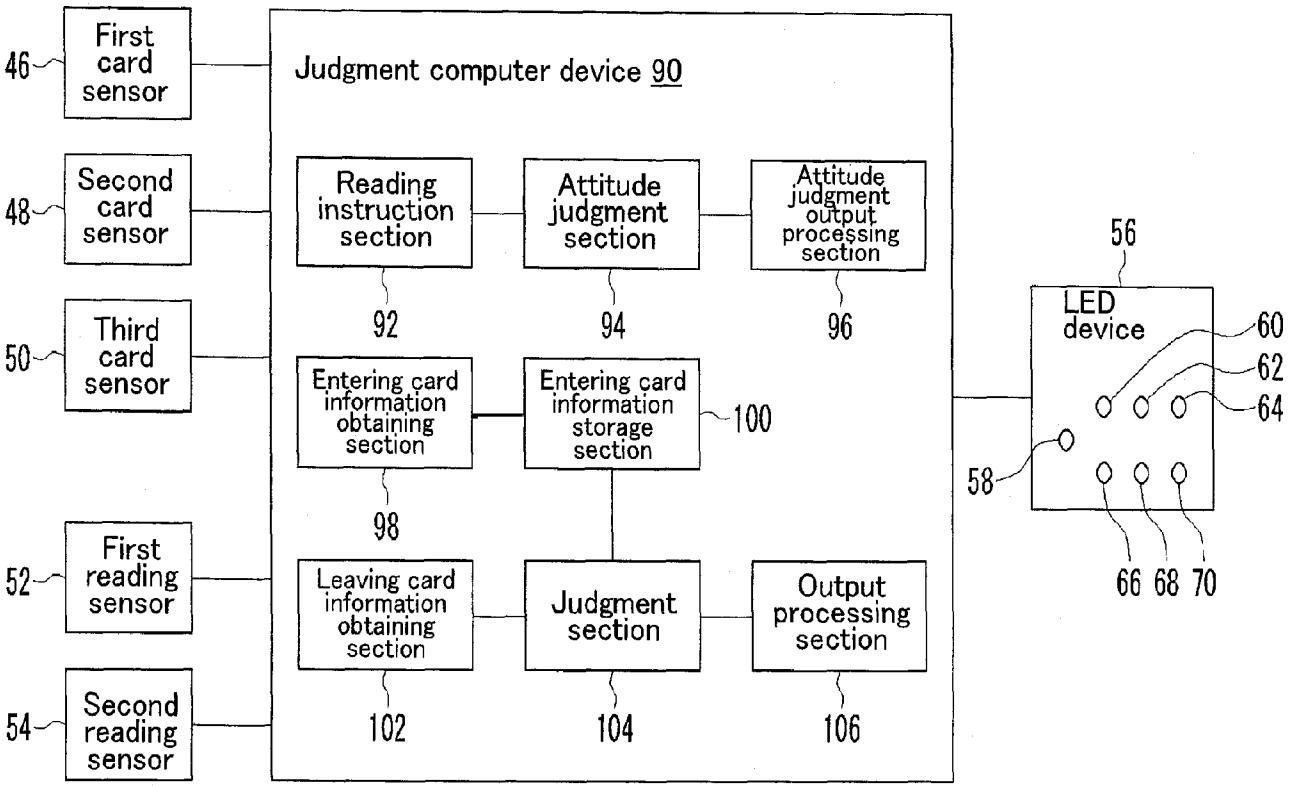
FIG. 12 is a functional block diagram showing a configuration of a judgment computer device.

FIG. 12 is a functional block diagram showing a configuration of the judgment computer device 90. The judgment computer device 90 receives detection signals from the first card sensor 46, the second card sensor 48, and the third card sensor 50. The judgment computer device 90 also controls the first reading sensor 52 and the second reading sensor 54 to have them read codes on a card, and receives detection signals from both sensors 52 and 54. The judgment computer device 90 further controls the LED device 56 to have it switch on and off the LED elements 58 to 70.

In FIG. 12, a reading instruction section 92 instructs the first reading sensor 52 and the second reading sensor 54 to start and end a reading operation. On receiving from the second card sensor 48 a detection signal indicating the existence of a card, the reading instruction section 92 has the sensors 52 and 54 start reading, so that barcodes are read. Then, on receiving from the third card sensor 50 a detection signal indicating the existence of a card, the reading instruction section 92 has the sensors 52 and 54 end reading.

Based on detection signals from the first card sensor 46, the second card sensor 48, and the third card sensor 50, an attitude judgment section 94 judges whether an attitude of a card at the time of slide was appropriate or not. As previously described, the attitude judgment section 94 judges that the card passed through in an appropriate attitude when: (1) the first card sensor 46, the second card sensor 48, and the third card sensor 50 detect the card in order; (2) these sensors detect that the card passed through (the card became nonexistent) in order; (3) the first card sensor 46 and the second card sensor 48 detect the card at the same time; and (4) the second card sensor 48 and the third card sensor 50 detect the card at the same time. When the attitude is appropriate, an attitude judgment output processing section 96 turns on the LED element 58 of the LED device 56.

Algorithms for the attitude judgment are not limited to the above. For example, it may be judged that an attitude is appropriate even if not all the above four conditions are met. However, using the above four conditions allows the attitude judgment to be more correct.

When codes are read from an entering card by the first reading sensor 52 and the second reading sensor 54, an entering card information obtaining section 98 obtains information on the read codes. This information is stored in an entering card information storage section 100 as entering card information for identifying an entering card. In Baccarat, up to six cards are dealt. Information on all dealt cards is obtained by the entering card information obtaining section 98, and is stored in the entering card information storage section 100. The entering card information storage section 100 holds entering card information while a game is being played.

When codes are read from a leaving card by the first reading sensor 52 and the second reading sensor 54, a leaving card information obtaining section 102 obtains information on the read codes. This information corresponds to leaving card information for identifying a leaving card.

A judgment section 104 refers to entering card information stored in the entering card information storage section 100 and to leaving card information obtained by the leaving card information obtaining section 102. By comparing these pieces of information, the judgment section 104 judges whether an entering card and a leaving card are identical or not.

The entering card information storage section 100 stores information on a plurality of entering cards. If one piece of the information is identical to a leaving card, it is judged that the entering card and the leaving card are identical.

An output processing section 106 outputs information on a judgment result by controlling the LED device 56. First, the output processing section 106 turns on one of the LED elements 60 to 70 each time one piece of entering card information is obtained. Then, the output processing section 106 turns off one of the LED elements 60 to 70 when leaving card information is identical to entering card information. When all the LED elements 60 to 70 go off, it is indicated that there was no fraud.

Preferably, when an entering card and a leaving card are identical, the LED element that lit up at the time of reading the entering card is turned off. For example, suppose the LED element 64 lit up when one entering card was read. When the entering card and one leaving card are identical, the LED element 64 is turned off. This enables to detect which player (player or banker) committed fraud.

The LED elements may be previously assigned to each player. For example, the LED elements 60 and 62 correspond to two cards of one player, and the LED elements 66 and 68 correspond to two cards of another player. If the LED elements are assigned to each player, a player who committed fraud can be distinguished more easily.

In Baccarat, order of dealing cards is usually defined up to second cards. If order of turning on the LED elements is appropriately set up according to the order of deal, the LED elements will be fixedly assigned to each player as above.

On the other hand, there are many times when a third card is dealt only to either player in Baccarat. Therefore, even if order of turning on the LED elements is set up according to order of dealing cards as above, correspondence between players and the LED elements varies depending on a situation of a game in regard to a third card.

However, as for a third card, it is relatively easy for both dealer and player to grasp which LED element lit up for which player's card.

Alternatively, by providing an appropriate configuration to detect which side that a third card is dealt to, a player and an LED element can be allowed to correspond to each other also as to a third card. For example, a switch may be provided to designate which player's card' code is read. A dealer may operate this switch.

Additionally, though not shown, an entering start switch and a leaving start switch are provided in the embodiment at appropriate places in order to distinguish between an entering card and a leaving card.

The entering start switch is operated by a dealer before a first entering card is read in each game. The entering start switch may be operated before a game starts.

The leaving start switch is operated by a dealer before a first leaving card is read. The leaving start switch may be operated when a game ends.

These switch operation are detected by the judgment computer device 90. After an operation of the entering start switch, information from the reading sensors 52 and 54 is treated as entering card information. After an operation of the leaving start switch, information from the reading sensors 52 and 54 is treated as leaving card information.

Entering cards and leaving cards may be distinguished by a configuration other than the above. For example, one switch may be operated before a start of entering and before a start of leaving.

Up to this point, the configuration of the fraud detection device 10 of the embodiment has been described. Now, the operation of the fraud detection device 10 will be described.

As is commonly known, Baccarat is continuously played on the table 1. When starting one game, a dealer operates the entering start switch. This operation is detected by the judgment computer device 90.

The dealer takes out cards one by one from the shooter 3 and deals them to players. At this time, the dealer slides the cards along the rail 18 while dealing the cards to the players.

When a card is slid in an appropriate attitude, the card is first detected by the first card sensor 46, and then by the second card sensor 48. Upon detection of a card by the second card sensor 48, the reading instruction section 92 instructs the first reading sensor 52 and the second reading sensor 54 to read codes, and barcodes 42 and 44 on the card are read. The two rows of codes 42 and 44 represent marks (a suit and a rank) on the card.

According to signals obtained from the sensors, the judgment computer device 90 identifies marks on the card. Entering card information is thus obtained by the entering card information obtaining section 98, and stored in the entering card information storage section 100.

The card moves to the third card sensor 50. Upon detection of the card by the third card sensor 50, the reading instruction section 92 instructs the first reading sensor 52 and the second reading sensor 54 to end reading. In response to this, the first reading sensor 52 and the second reading sensor 54 end the reading operation. Incidentally, the black light may keep on lighting up regardless of a detection result of the card sensors.

The attitude judgment section 94 of the judgment computer device 90 judges whether an attitude of a card at the time of slide was appropriate or not. Judgment criteria are as already described. As previously mentioned, this judgment result indicates whether codes were read with a side of the card being in contact with the rail 18 or not. If the attitude is appropriate, the attitude judgment output processing section 96 turns on the LED element 58. If the attitude is not appropriate, the LED element 58 does not light up. In this instance, the dealer slides the card along the rail 18 again.

The output processing section 106 turns on one of the LED elements 60 to 70 each time codes are read from one card.

The above operation repeats for all entering cards. Each time one entering card enters, codes on the entering card are read and stored in the judgment computer device 90, and one of the LED elements lights up.

Next, the dealer operates the leaving start switch when a game ends. The dealer then inserts cards used in the game one by one into the recovery opening 5. At this time, the dealer slides each card along the rail 18 while moving the cards to the recovery opening.

Upon a slide of a card, codes on each leaving card are read by the first reading sensor 52 and the second reading sensor 54. The reading operation is the same as that of reading an entering card. Attitude judgment is also made in a like manner. If the attitude is not appropriate, the dealer slides the card again, and a reading operation is performed.

Information on codes read from a leaving card is obtained by the leaving card information obtaining section 102. The leaving card information obtaining section 102 thus obtains leaving card information.

The judgment section 104 compares leaving card information to entering card information. If the entering card information storage section 100 stores entering card information that is identical to leaving card information, the judgment section 104 judges that an entering card and a leaving card are identical. The output processing section 106 then turns off one of lighting LED elements. Preferably, as previously described, when one entering card is identical to a leaving card, an LED element corresponding to the entering card is turned off.

The above judgment process and LED control are repeated each time codes are read from each leaving card. If all leaving cards are identical to entering cards, all the LED elements go off. This makes it clear that there was no substitution of cards in a game and that there was no fraud.

Conversely, suppose one or a plurality of LED elements did not go off. In this case, it is clear that there was a substitution of cards in a game and that there was a fraud.

Up to this point, a preferred embodiment of the invention has been described. Variations of the embodiment will now be described.

UV-luminous ink and sensors that detect the ink are used in the embodiment. A code in UV-luminous ink is invisible to a naked human eyes, and this is an example of a code that is visible under certain conditions. In contrast to this, another configuration is conceivable. For example, ink that is visualized by infrared light may be applied. For another example, a code may be provided on a card by using magnetism. In this case, magnetic sensors are provided on the detection device.

A certain kind of ink becomes visible at a certain temperature. A code may be printed on a card by using such ink. In this case, the detection device has a configuration in which the temperature of a surface of a card is varied.

Sensors are of course modified according to the type of a code. An appropriate barcode reader, a CCD camera, and the like can be used as a sensor according to a code.

In the above embodiment, the base plate 12 corresponds to the base section, and the base section is a member separate from the table. However, the embodiment is not limited to this. The base section need not be a member different from the table. In this case, the rail, the sensors, and the LED device may be mounted in an area of a member that forms the table.

Though the above embodiment comprises a plurality of LED elements respectively corresponding to a plurality of cards, the embodiment is not limited to this. For example, only one LED element may be provided. In this case, the LED element may be turned on when fraud is detected, that is, when a leaving card that is not identical to any entering card is found.

LED elements are used in the above embodiment, but an indicator other than LED elements may of course be used. Moreover, though a judgment result is outputted using an indicator on the table, the embodiment is not limited to this. The indicator need not be provided on the table. The indicator may be provided at a remote site such as a control room of a casino or the like. In addition, a judgment result may be sent to a computer in a control room or the like.

A judgment result may be outputted with an audible alarm. In this case, a speaker is provided. A sound other than an audible alarm, e.g. a voice message or a melody, may be outputted.

In the embodiment, the codes 42 and 44 are printed on a card as shown in FIG. 3. The codes 42 and 44 represent a suit and a rank, respectively, and these codes are used as entering card information and leaving card information.

However, entering card information and leaving card information may be minimum information required according to a rule of a card game to which the device is applied. In Baccarat, suits do not affect a game, and J, Q, and K are treated as 10. Therefore, entering card information and leaving card information may only be 1 to 10 (J, Q, and K are included in 10). It is acceptable that only such codes are given to cards.

Codes may be set up not to correspond to marks on cards. For example, a random number is given to a card as a code. The device need not recognize a mark on a card. Since it is enough to judge conformity between an entering card and a leaving card, fraud can be detected without identifying a mark on a card. As the device does not recognize a mark on a card, a player's feeling that a game is played fairly can be further increased.

Moreover, within the scope of the invention, the device may use as entering card information and leaving card information a code representing a group (or set). A group may be one deck or a plurality of decks. A group code attached to an entering card is compared with a group code attached to a leaving card. Conformity between an entering card and a leaving card can also be judged in this case. Information other than a group code, which brings the same result, may of course be used.

In another example, the reader reads from a leaving card a code representing a group. A group code is previously inputted into the judgment computer device 90. The group code is a code of a group reserved in a card-providing source (shooter etc.). Preferably, a group of new cards or a group of previously inspected cards is placed in the card-providing source. The inputted group code is obtained and stored as entering card information. The read code is then compared with the stored code.

Conformity between an entering card and a leaving card can also be judged in this configuration, provided that cards of the same group are placed in the card-providing source. Information other than a group code, which brings the same result, may of course be used. In this configuration, information need not be read from each entering card.

In this configuration, since an entering card is not read at the beginning, it is preferable that the control of the LED device be appropriately modified from the above embodiment.

In still another example, a group code need not be previously inputted. Group codes of a plurality of leaving cards are compared with each other, and when there is a leaving card that has a group code different from the others, the leaving card is judged not to be identical to an entering card. Supposing that a group code of a first leaving card is the appropriate group code of entering cards, the group code may be compared with group codes of other leaving cards.

Further describing the above configuration, there are not many times when a plurality of cards are substituted in an actual fraud. Usually one or a small number of cards are substituted. On the assumption of this, conformity between an entering card and a leaving card can also be judged by the above comparison between codes on leaving cards. Also in the embodiment, a fraud can be detected on the spot by the judgment of conformity among cards in a game as previously described.

In a configuration where a group code is used, a fraud cannot be detected when one card is substituted for a card of the same group, and the effectiveness of fraud detection is limited in this respect. However, a card of a different group is used in relatively many frauds, and the difference between an entering card and a leaving card is detected in such a case, so that a fraud can be detected.

On the other hand, it can be said that the previously described embodiment is more advantageous in that a fraud using a card of the same group can be detected.

Additionally, within the scope of the invention, both a group code and information on a mark on a card may be used for fraud detection.

Figure 13:
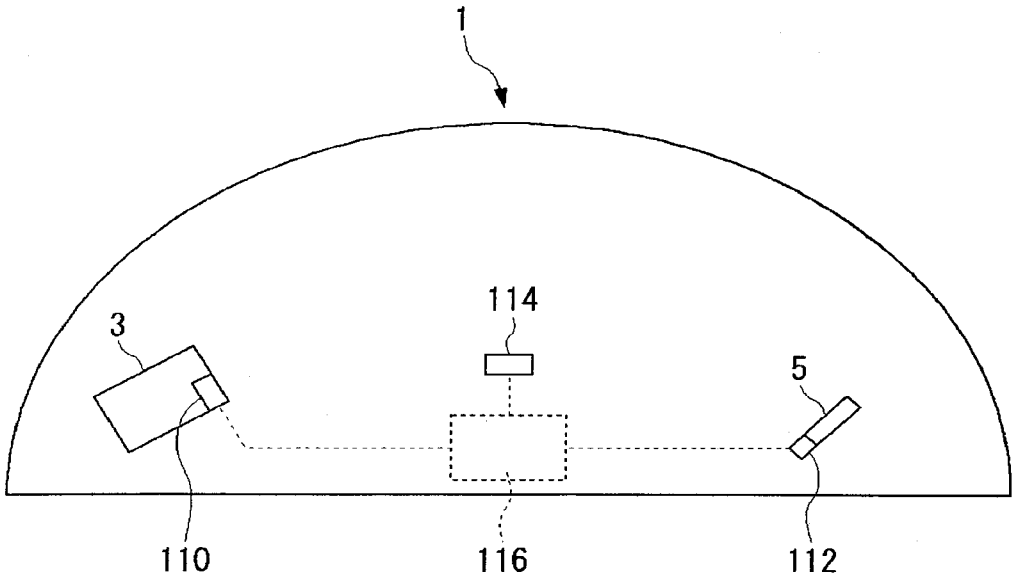
FIG. 13 shows another embodiment.

FIG. 13 shows another embodiment. Descriptions of matters like those of the above embodiment will be appropriately omitted in the following description.

As shown in FIG. 13, an entering sensor 110 is provided at a shooter 3 in the embodiment. The shooter 3 is provided with a configuration for guiding a card. The entering sensor 110 reads a code from an entering card that is guided when going out from the shooter 3.

In addition, a leaving sensor 112 is provided at a recovery opening 5. The recovery opening 5 is also provided with a configuration for guiding a card. The leaving sensor 112 reads a code from a leaving card that is guided when passing through the recovery opening 5.

Moreover, an LED device 114 is provided near the center of a table 1, and a judgment computer device 116 is mounted on the underside of the table 1. The judgment computer device 116 performs a judgment process like that of the above embodiment based on read signals from the entering sensor 110 and the leaving sensor 112. The judgment computer device 116 then controls the LED device 114 and shows a judgment result. A configuration of the judgment computer device regarding the judgment process or the like may be the same as that of the above embodiment.

As can be seen in the embodiment, entering card information and leaving card information may be read by different readers.

In addition, guide means are provided at the shooter 3 and the recovery opening 5 in the embodiment. These guide means are used for reading a code on a card. A dedicated guide means need not be provided for the fraud detection device. The configuration of the device is therefore simplified.

Figure 14:
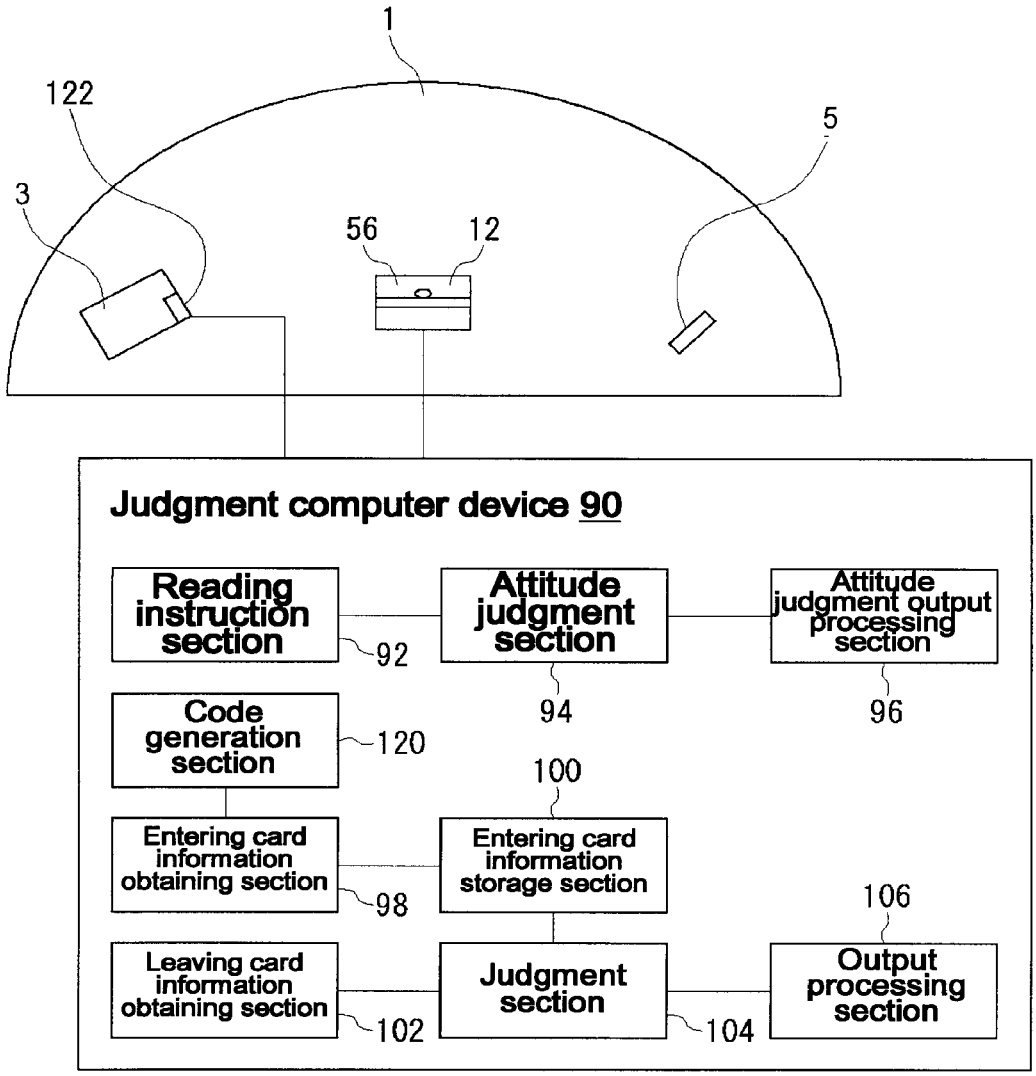
FIG. 14 shows another embodiment.

FIG. 14 shows another embodiment. In the embodiment, a code is added to a card when an entering card enters. For this reason, a code need not be read from an entering card. A code is read from a leaving card, as is the case with the previously described embodiment.

In FIG. 14, a base plate 12 and sensors and LEDs mounted thereon may be the same as those of the previously described embodiment. A judgment computer device 90 has the configuration of the previously described embodiment, and further has a code generation section 120 for generating a code to be printed on an entering card. Additionally, a code printing device 122 is provided at the shooter 3.

In the embodiment, the code generation section 120 generates a code. A code is a random number. This code is sent from the judgment computer device 90 to the code printing device 122. When a card is discharged from the shooter 3, the code printing device 122 prints on the card a code received from the judgment computer device 90. A code is thus added to a card.

The code printing device 122 informs the judgment computer device 90 that it has printed a code on a card. In response to this, the code generation section 120 generates a next code. A random number is also generated here.

Such operation is repeated, and codes of random numbers will be being printed on cards that enter successively.

In the judgment computer device 90, when the code generation section 120 has generated a code, an entering card information obtaining section 98 obtains this code. The obtained code is stored in an entering card information storage section 100 as entering card information.

In the embodiment, entering card information is obtained as above. Therefore, a card need not be read by the sensors on the base plate 12 when the card is dealt. At an end of a game, the sensors on the base plate 12 read a code from a leaving card. The read signals are sent to the judgment computer device 90. The judgment computer device 90 judges whether an entering card and the leaving card are identical or not, as is the case with the previously described embodiment.

A fraud detection device of the embodiment can detect a fraud by judging whether an entering card and a leaving card are identical or not, as with the previously described embodiment.

In the embodiment, the code generation section 120 generates a random number. In this case, a code does not correspond to a mark on a card, so the detection device does not recognize a mark on a card. However, even if a mark is not recognized, a comparison between an entering card and a leaving card can be made, so that a fraud is detected reliably. As the device does not recognize a mark on a card, a player's feeling that a game is played fairly can be further increased.

In the above embodiment, the code printing device is one form of information addition means, but the embodiment is not limited to this. An information addition means is made to suit to specifications of a code. For example, in a case where a magnetic code is applied, a device for adding a magnetic code corresponds to the information addition means.

Now, another embodiment will be described. In the following embodiment, a mark on a card is read instead of a code given to a card. Particularly, a configuration for reading a mark on a card is simple in the embodiment.

Figure 15:
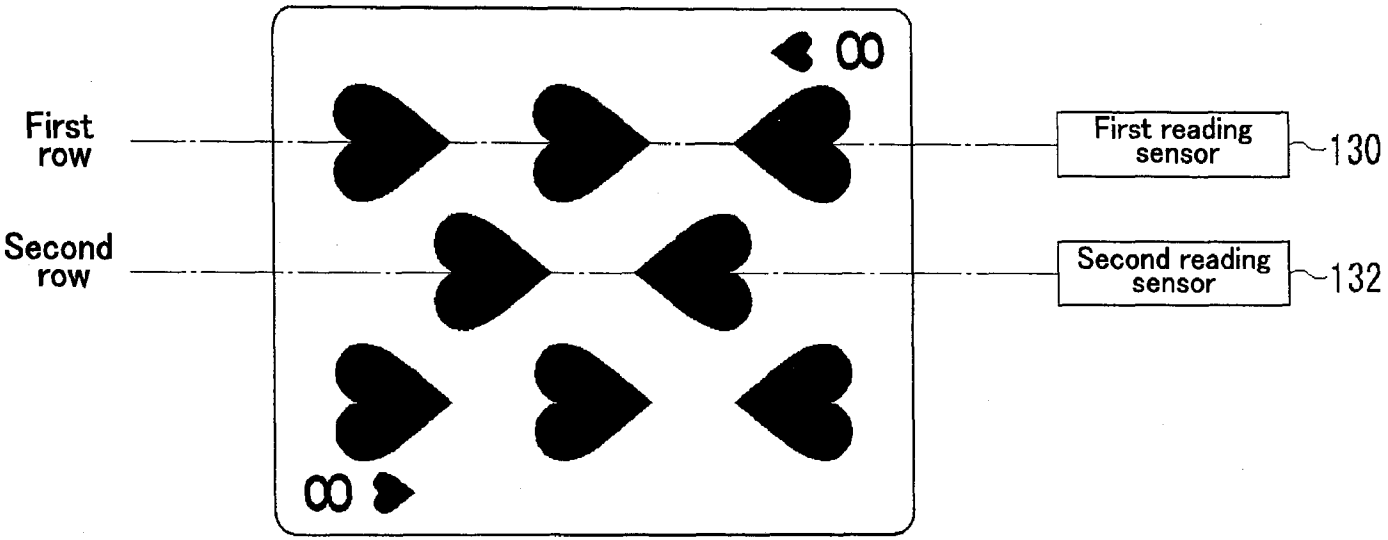
FIG. 15 shows another embodiment.

Referring to FIG. 15, marks form three rows longitudinally on a card. As shown in FIG. 15, two sensors are provided to detect a central mark row and one of mark rows on both sides.

More specifically, in the embodiment, one of mark rows on both sides is called a first row, and the central mark row is called a second row. A first reading sensor 130 is so placed as to read a mark in the first row, and a second reading sensor 132 is so placed as to read a mark in the second row.

These sensors 130 and 132 comprise a camera. The sensors 130 and 132 need only be able to detect the presence or absence of a mark. For this reason, a sensor that can distinguish between a colored part (red or black) and a white part of a card is applied as the sensors 130 and 132. In short, the sensors 130 and 132 detect a difference in color between a mark and a part where there is no mark on a card.

The sensors 130 and 132 are provided instead of the sensors for reading UV-luminous ink of the above embodiment. While the sensors read a code on an edge of a card in the above embodiment, the sensors 130 and 132 read marks in the first row and the second row in this embodiment. According to this difference, positions of the sensors are modified, and positions of windows of the base plate are also modified. In addition, a light for lighting a card is provided as required.

A mark reading process in the embodiment will now be described. Arrangements of marks are common in all popular cards, where one to ten marks are placed in three rows. The number of marks is determined using this characteristic.

Figure 16:
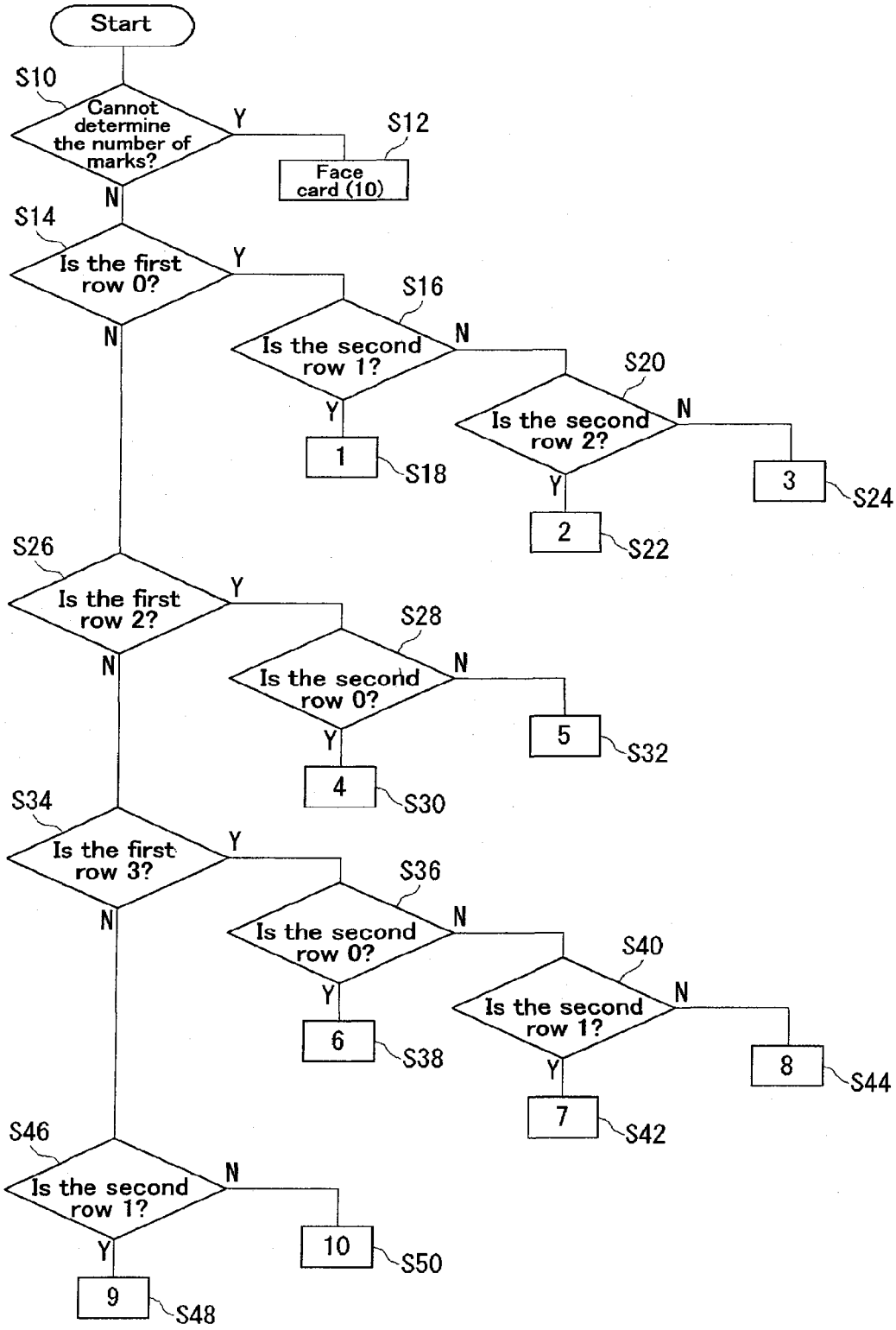
FIG. 16 is a flowchart showing a process for determining the number of marks on a card in the embodiment of FIG. 15.

FIG. 16 shows an algorithm for determining the number of marks. This algorithm is executed by a judgment computer device. The judgment computer device receives detection signals from the first reading sensor 130 and the second reading sensor 132. Based on the detection signals, the numbers of marks in the first row and the second row are determined. The process of FIG. 16 is then performed using the numbers of marks in the first row and the second row.

In the process of FIG. 16, the judgment computer device first judges whether the number of marks is determined or not (S10). As is commonly known, face cards (J, Q, and K) are printed with complex patterns, so that the number of marks is not determined. In this case, it is judged that the number of marks is ten (S12). This judgment is appropriate since J, Q, and K are treated as ten (or zero) in Baccarat.

Next, if S10 is NO, the judgment computer device judges whether the number of marks in the first row is zero or not (S14). If S16 is YES, whether the number of marks in the second row is one or not is judged (S16). If S16 is YES, it is judged that the number of marks is one (A) (S18).

By the way, it is desirable that the pattern of the Ace of spades in cards used in the embodiment has the size of a certain range. The size of the pattern of the Ace of spades need only be in a range where the card can be distinguished from face cards. The Ace of spades may be detected as the other Aces are.

As for the Ace of spades, the judgment computer device 90 may judge whether a mark different from face cards but larger than other marks is detected or not, and may judge that the target card is the Ace of spades when such a mark is detected. This step is inserted, for example, after S10 (not shown). Here, it is considered that the Ace of spades is larger than marks of the other Aces or the like and is complicated.

For another variation, the mark of the Ace of spades may have the same dimensions and size as the other spades have.

If S16 is NO, whether the number of marks in the second row is two or not is judged (S20). If S20 is YES, it is judged that the number of marks is two (S22), or if S20 is NO, it is judged that the number of marks is three (S24).

If S14 is NO, the judgment computer device judges whether the number of marks in the second row is two or not (S26). If S26 is YES, whether the number of marks in the second row is zero or not is judged (S28). If S28 is YES, it is judged that the number of marks on the card is four (S30), or if S28 is NO, it is judged that the number of marks is five (S32).

If S26 is NO, the judgment computer device judges whether the number of marks in the first row is three or not (S34). If S34 is YES, whether the number of marks in the second row is zero or not is judged (S36). If S36 is YES, it is judged that the number of marks on the card is six (S38). If S36 is NO, whether the number of marks in the second row is one or not is judged (S40). If S40 is YES, it is judged that the number of marks is seven (S42), or if S40 is NO, it is judged that the number of marks is eight (S44).

If S34 is NO, the judgment computer device judges whether the number of marks in the second row is one or not (S46). If S46 is YES, it is judged that the number of marks is nine (S48), or if S46 is NO, it is judged that the number of marks is ten (S50).

As above, the process of FIG. 16 can determine the number of marks on a card (the card number) using the arrangement characteristic of marks on cards. This number of marks is processed by the judgment computer device as entering card information and leaving card information. The entering card information and the leaving card information are then compared and judged whether the two are identical or not.

As described above, within the scope of the invention, a mark on a card may be read in order to obtain entering card information and leaving card information.

In the embodiment, a mark can be read with a simple configuration by using arrangements of marks.

In the embodiment, the process of FIG. 16 determines the number of marks. However, the embodiment is not limited to this. The algorithm of FIG. 16 may be varied. For example, the number of marks in the second row may be judged first. For another example, a table corresponding to the algorithm of FIG. 16 may be stored in the judgment computer device. In this table, combinations of the numbers of marks in the first row and the second row are associated with the numbers of marks on cards. The card number is determined by referring to this table.

As a variation of the embodiment, the number of marks on a card may be determined by calculation. In this case, twice the number of marks in the first row and the number of marks in the second row are added up.

As a variation of the embodiment, three sensors may be provided corresponding to the three mark rows. The numbers of marks detected by the three sensors are summed up. This sum represents the number of marks.

A different configuration may also be applied for reading a mark within the scope of the invention. For example, a rank (A, 2 . . . 10, J, Q, or K) is printed on four corners of a card. This rank may be shot by a camera, and the rank may be identified by image processing. However, the above-described configuration where arrangements of marks are used is simpler than such a configuration.

Another embodiment will be described next. The principle of the embodiment is the same as that of the above embodiment. However, the embodiment focuses on transverse mark rows.

Figure 17:
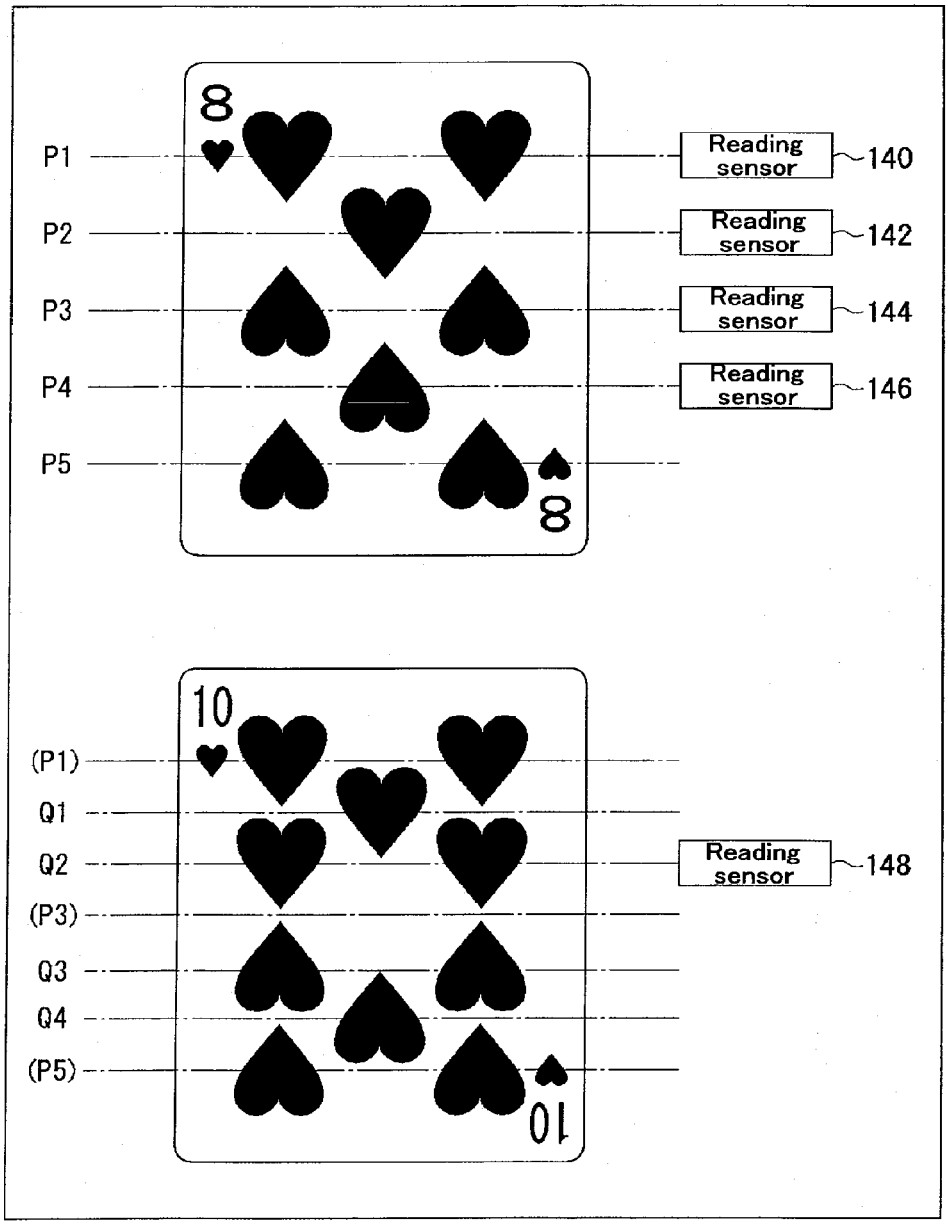
FIG. 17 shows another embodiment.

Referring to FIG. 17, there are nine transverse mark rows on a card. The upper part of FIG. 17 is an Eight card, where five mark rows P1 to P5 are shown. The lower part of FIG. 17 is a Ten card, where the other four mark rows Q1 to Q4 are shown. In the nine mark rows, there are rows in which only one mark can exist (P2, P4, Q1, and Q4). These are also called mark rows in the embodiment.

In the embodiment, five sensors are provided to detect marks in five mark rows out of the nine mark rows. The five mark rows are a central mark row, one of mark rows on both edges, two mark rows on both sides of a center of an Eight card, and one of two mark rows on both sides of a center of a Ten card (the same in a Nine card).

Specifically, as shown in FIG. 17, reading sensors 140 to 148 are provided corresponding to the mark rows P1, P2, P3, P4, and Q2. Actually, these sensors are arranged at appropriate intervals on a base plate. P2 and Q2 may be read by one sensor. In this case, reading the five lines may be realized by providing four sensors.

The reading sensors 140 to 148 may be the same as those of the above embodiment. That is, the sensors 140 to 148 comprise a camera, and output signals to distinguish between a mark part and a background part of a card. Detection signals are sent to a judgment computer device, where the numbers of marks in each row are determined.

In the embodiment, a card is slid transversely. The sliding direction is perpendicular to the sliding direction in the above embodiments. The configuration of the guide rail, card sensors, and the like are modified to accommodate the difference.

Figure 18:
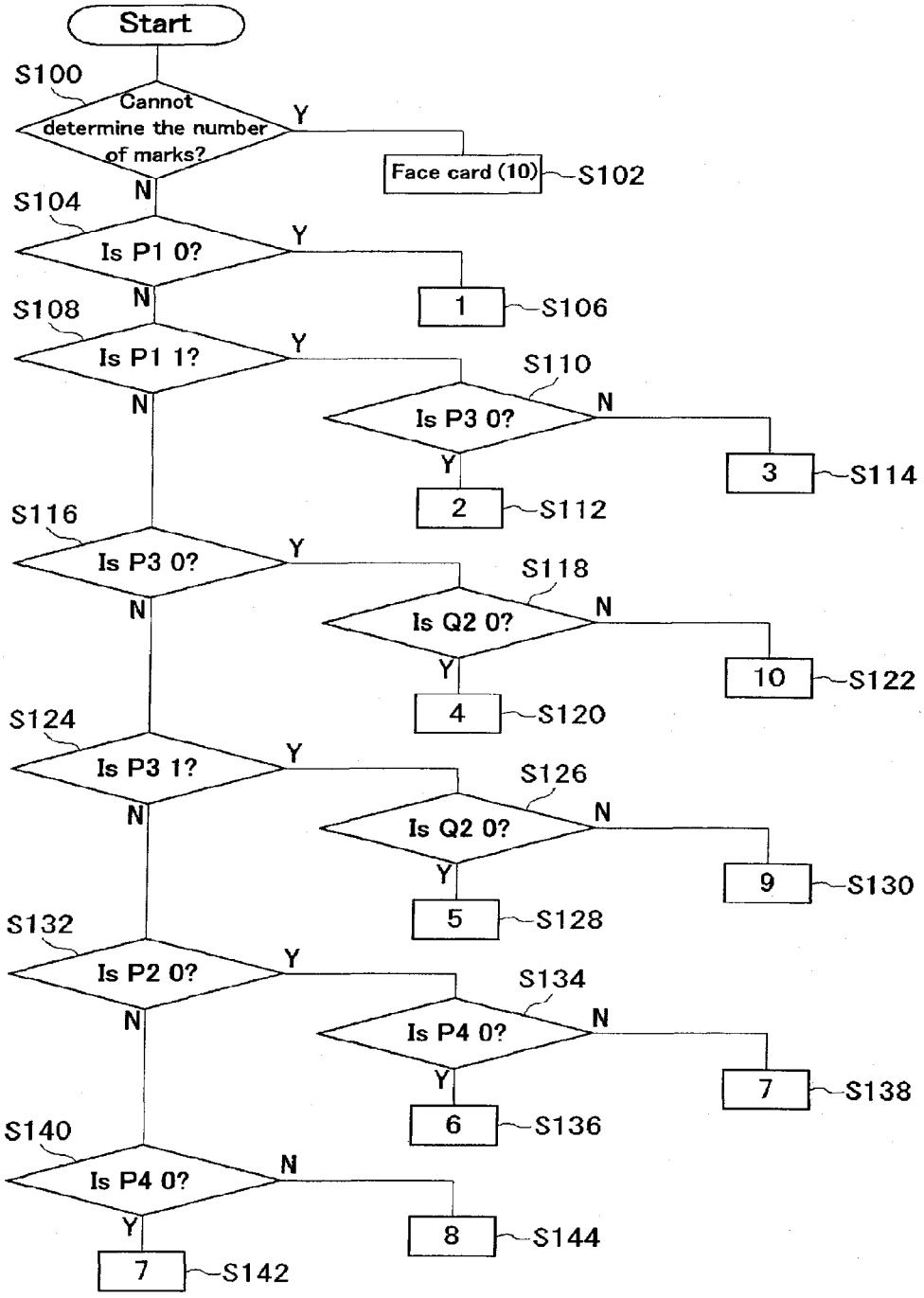
FIG. 18 is a flowchart showing a process for determining the number of marks on a card in the embodiment of FIG. 17.

FIG. 18 shows a process performed by the judgment computer device. This process determines the number of marks on a card.

In the process of FIG. 18, the judgment computer device first judges whether the number of marks is determined or not (S100). When face cards (J, Q, and K) are read, the number of marks is not determined. In this case, it is judged that the number of marks is ten (S102). The embodiment is the same as the previously described embodiment in this respect.

Next, if S100 is NO, the judgment computer device judges whether the number of marks in P1 is zero or not (S104). If S104 is YES, it is judged that the number of marks is one (S106). The processing of the Ace of spades may be the same as that of the previous embodiment.

If S104 is NO, the judgment computer device judges whether P1 is one or not (S108). If S108 is YES, whether P3 is zero or not is judged (S110). If S110 is YES, it is judged that the number of marks is two (S112), or if S110 is NO, it is judged that the number of marks is three (S114).

If S108 is NO, the judgment computer device judges whether P3 is zero or not (S116). If S116 is YES, whether Q2 is zero or not is judged (S118). If S118 is YES, it is judged that the number of marks is four (S120), or if S118 is NO, it is judged that the number of marks is ten (S122).

If S116 is NO, the judgment computer device judges whether P3 is one or not (S124). If S124 is YES, whether Q2 is zero or not is judged (S126). If S126 is YES, it is judged that the number of marks is five (S128), or if S126 is NO, it is judged that the number of marks is nine (S130).

If S124 is NO, the judgment computer device judges whether P2 is zero or not (S132). If S132 is YES, whether P4 is zero or not is judged (S134). If S134 is YES, it is judged that the number of marks is six (S136), or if S134 is NO, it is judged that the number of marks is seven (S138).

If S132 is NO, the judgment computer device judges whether P4 is zero or not (S140). If S140 is YES, it is judged that the number of marks is seven (S142), or if S140 is NO, it is judged that the number of marks is eight (S144).

Also in the embodiment, the algorithm may of course be varied. A table may be prepared and referred to by the judgment computer device. Moreover, the number of marks may be calculated from a detection result of sensors. In this case, marks in at least the Q1 row or Q4 row are detected in addition to the above five rows. Of course, marks in more rows may be detected.

Also in the embodiment, the number of marks can be detected with a relatively simple configuration. However, the configuration of the above embodiment of FIG. 15 is simpler, since fewer sensors are required.

Now, another embodiment will be described. In the embodiment, a black light is used to read a code from a card. A configuration relating to reading a code is different from that of the embodiment of FIG. 1. A configuration and operation relating to a judgment of fraud, output of the judgment, and other processes for a read code may be the same as those of the embodiment of FIG. 1. Descriptions of matters like those of the embodiment of FIG. 1 will be appropriately omitted in the following description.

Figure 19:
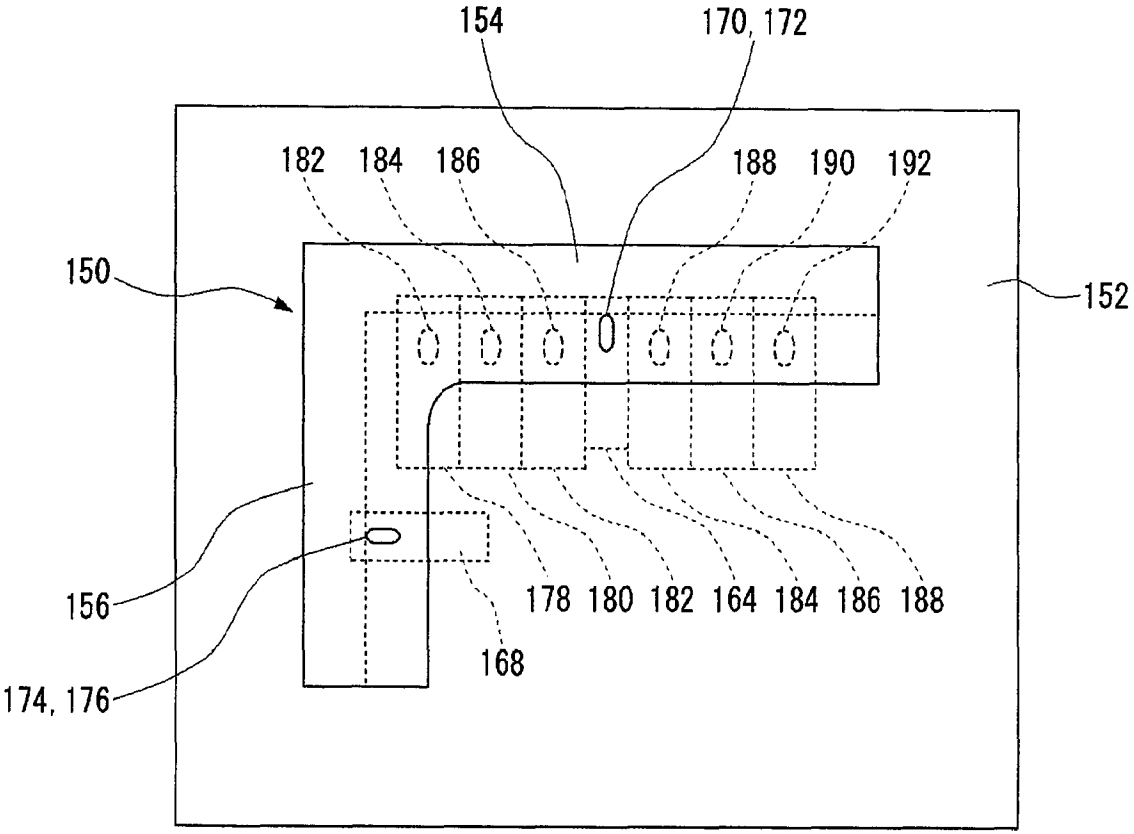
FIG. 19 shows another embodiment.

FIG. 19 shows a configuration for reading a code in the embodiment. In the embodiment, a guide 150 is provided on a table in order to guide a card. The guide 150 is provided on a base plate 152 that is embedded in the table. The guide 150 may be attached directly to the table.

As shown in the figure, the guide 150 has an L shape as a whole. The guide 150 comprises a long side guide 154 and a short side guide 156, which guide a long side and short side of a card, respectively. The long side guide 154 and the short side guide 156 are rod-shaped and connected with each other at a right angle.

Figure 20:
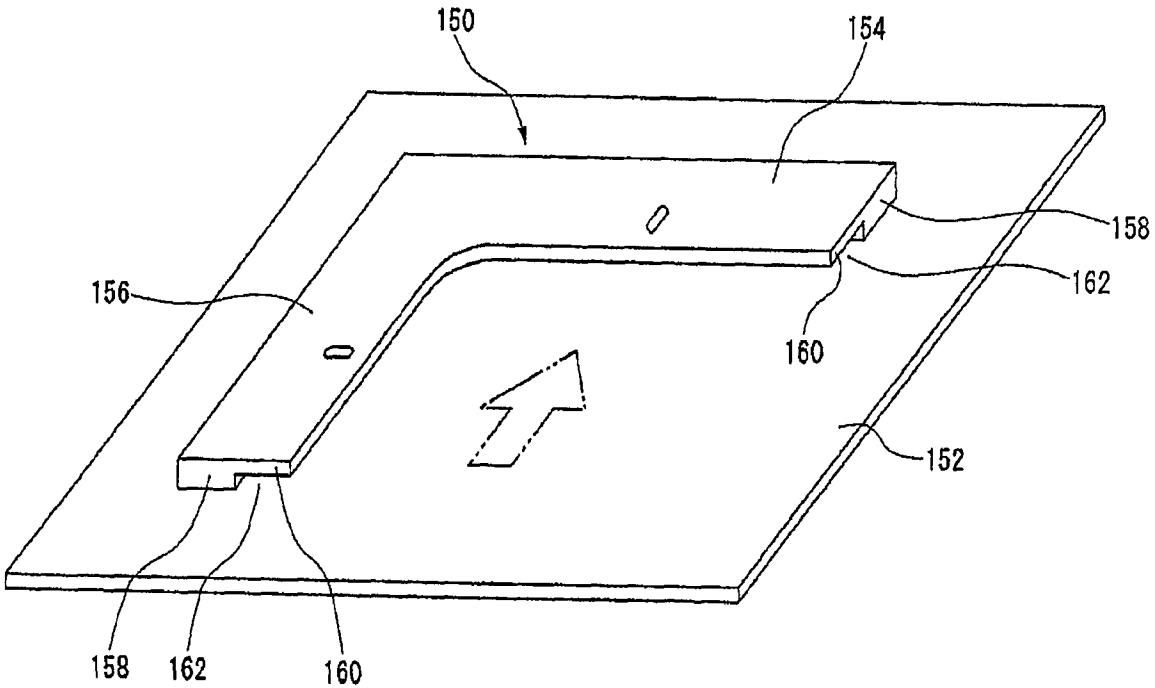
FIG. 20 is a perspective view of the configuration of FIG. 19.

Referring to a perspective view in FIG. 20, the long side guide 154 and short side guide 156 of the guide 150 have a guide wall section 158 and a cover section 160. The cover section 160 extends from the guide wall section 158 parallel to the base plate 152. This forms a gap 162 between the cover section 160 and the base plate 152.

When a code is read, a card is inserted into the gap 162 by a dealer. The dealer then appropriately slides the card to make a long side and short side of a card meet the guide wall section 158 of the long side guide 154 and short side guide 156. This allows the card to be guided to a certain reading position. That is, the certain reading position is a position where both the long side and short side of the card are in contact with the guide wall 158.

Returning to FIG. 19, a card check sensors 164 and 168 are provided under the cover section 160 of the long side guide 154 and short side guide 156. These sensors 164 and 168 are mounted on the backside of the base plate 152 using an appropriate plate (not shown) as is shown in the previous embodiment. The card check sensors 164 and 168 are photoelectric sensors, and have a function to detect the presence or absence of a card. In order to ensure this function, the base plate 152 and the guide 150 have windows 170, 172, 174, and 176 at positions corresponding to the card check sensors 164 and 168.

In addition, six code reading sensors 178 to 188 are provided under the cover section 160 of the long side guide 154. These sensors 178 to 188 are also mounted on the backside of the base plate 152 using an appropriate plate. The code reading sensors 178 to 188 are a kind of black light sensor used in the previous embodiment. That is, the sensor comprises a black light LED and detects ink that reacts to black light.

The code reading sensors 178 to 188 are arranged at appropriate intervals, at equal intervals in FIG. 19, along the long side guide 154. Windows 182 to 192 for the sensors are also provided on the base plate 152, corresponding to the code reading sensors 178 to 188.

Figure 21:
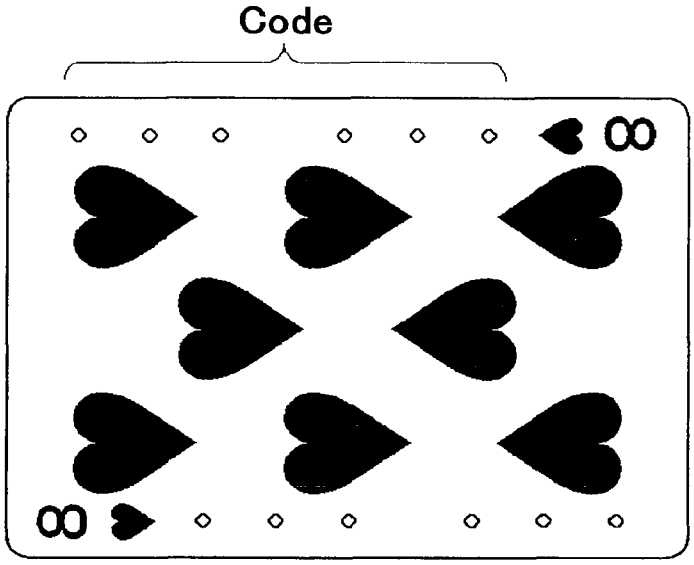
FIG. 21 shows a card to be applied to the embodiment of FIG. 19.

FIG. 21 shows a card to be applied to the embodiment. A code on a card is represented by six circles. These six circles represent a card attached with a code in binary notation. In the binary system, a six-digit code can represent 64 integers. Using 64 integers, different numbers are assigned to each of all cards of one deck (1, 2, 3 . . . J, Q, and K of spades, hearts, diamonds, and clubs). Circle marks are provided at positions corresponding to an assigned number. Therefore, though six circles are shown in FIG. 21, an actual card has circle marks only at positions corresponding to a number assigned to the card.

A code of FIG. 21 is printed on a card by using ink that is invisible under normal use conditions. The positions of six circle marks correspond to the positions of the code reading sensors 178 to 188.

An operation of the embodiment will be described next. This operation is to read a code on a card, and is typically performed at a start and end of a game. However, various variations are conceivable in this respect as previously described.

When reading a code from a card, a dealer slides the card on the table toward the guide 150 (e.g. in the direction of an arrow in FIG. 20). The card is inserted into the gap 162 under the cover section 160 of the guide 150. A long side and short side of the card then meet the guide wall section 158 of the long side guide 154 and short side guide 156, respectively, and the card stops. In this way, a card is guided to the reading position and positioned.

Figure 22:
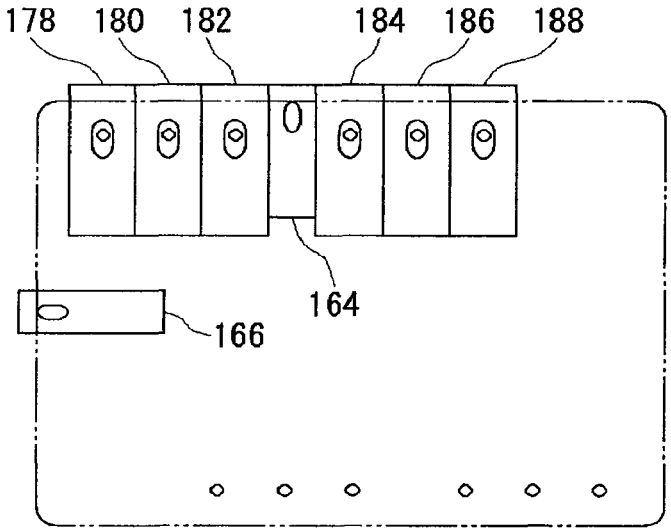
FIG. 22 shows a code reading operation according to the embodiment of FIG. 19.

FIG. 22 shows a positional relationship between a card and the sensors. As shown in FIG. 22, when a card is placed at the reading position and its two sides are in contact with the guide wall 158, the card check sensors 164 and 168 detect the existence of the card at the same time. If both sensors detect the card, an attitude judgment section of a judgment computer device (not shown) judges that an attitude of the card is appropriate. The judgment result is outputted using an appropriate LED device or other output devices.

When the attitude is appropriate, positions of six circle marks on the card correspond to the code reading sensors 178 to 188, respectively, as shown in FIG. 22. The judgment computer device then instructs the code reading sensors 178 to 188 to read a code. In response to this, each of the code reading sensors 178 to 188 detects the presence or absence of its opposing circle mark. If there is any circle mark, the black light visualizes the circle mark, which is detected by the sensor. Each of the sensors 178 to 188 outputs a detection signal indicating the presence or absence of a circle mark.

These detection signals are inputted into the judgment computer device. The judgment computer device stores correspondences between cards and codes. Referring to these correspondences, a card is identified by means of detection signals. This identification information is used as entering card information and the like, so that a judgment of a fraud is made. Output of the judgment and its result may be performed similarly to the previously described embodiment. The previously mentioned LED device may be provided for the output of the judgment result.

Up to this point, another preferred embodiment has been described. Also in the embodiment, a code on a card is read by an appropriate configuration, so that a fraud is detected.

In the embodiment, a code corresponds to a mark (a rank and a suit) on a card. However, the embodiment is not limited to this. A code need not correspond to a mark on a card. This is as already explained.

Various embodiments have thus far described. The above embodiments may of course be varied within the scope of the invention by those skilled in the art. For example, the invention may detect fraud in a game other than Baccarat. In this case, devices of the embodiments may be appropriately varied as required in the applicable game.

As described so far, the fraud detection device judges whether an entering card and a leaving card are identical or not, and outputs the judgment result. Therefore, when a card is fraudulently substituted in a game, this act of substitution can be detected.

The device has only to obtain information on entering cards and leaving cards. In a game of Baccarat, for example, the numbers of entering cards and leaving cards are at most six. For this reason, a means to transfer a group of cards need not be provided, so that the device can be composed simply and inexpensively.

The fraud detection device can detect fraud in a card game, with a simple configuration comprising a reader provided at or near a table. Any conventional and common device for continuously transferring cards need not be provided. In addition, a fraud can be detected on the spot.

Moreover, the mark reading device can determine the number of marks with a simple configuration, focusing on the fact that arrangement patterns of marks on cards are fixed.

Industrial Applicability

As stated above, the card of the invention is useful to detect in casinos or the like a fraud that is difficult to be detected by human beings.

The invention claimed is:

1. A card used in a card game, comprising:

a code including at least two sets of invisible code elements printed on a surface of the card, each set comprising at least two adjacent rows of the invisible code elements, each of the at least two sets of code elements provided on a respective side of the surface of the card.

2. The card of claim 1, wherein each set of code elements represents different content.

3. The card of claim 1, wherein the sets of code elements are spaced from an edge of the card.

4. The card of claim 1, wherein the code indicates a group code which represents a group to which the card belongs.

5. The card of claim 4, wherein the group to which the card belongs includes one or more decks of cards.

6. The card of claim 1, wherein the sets of code elements are printed where no mark is printed.

7. The card of claim 1, wherein, within each set of code elements, the rows are arranged along a reading direction of a code reader.

8. The card of claim 1, wherein the sets of code elements are adjacent to each other.

9. The card of claim 1, wherein the sets of code elements are stacked inwardly from an edge of the card.

10. The card of claim 1, wherein the code corresponds to an identification number to identify the card.

11. The card of claim 10, wherein the identification number is unique to each individual card in a deck of cards.

12. The card of claim 11, wherein the identification number is a binary code.

13. The card of claim 1, wherein the code indicates the rank and suit of the card.

14. The card of claim 13, wherein one set of code elements indicates at least a rank of the card.

15. The card of claim 1, wherein the same code is provided on both sides on the surface of the card along a reading direction of a code reader.

* * * * *